US005735169A

United States Patent [19]

Niimi et al.

[11] Patent Number: 5,735,169

[45] Date of Patent: Apr. 7, 1998

[54] STARTER HAVING MAGNET SWITCH WITH HEAT DISSIPATION CHARACTERISTICS

[75] Inventors: Masami Niimi, Handa; Masanori Ohmi, Anjo; Tsutomu Shiga, Nukata-gun; Nobuyuki Hayashi, Nagoya, all of Japan

[73] Assignee: Nippoondenso Co., Ltd., Kariya, Japan

[21] Appl. No.: 564,519

[22] Filed: Nov. 29, 1995

[30] Foreign Application Priority Data

Nov. 29, 1994 [JP] Japan ..... 6-294818
Nov. 24, 1995 [JP] Japan ..... 7-305674

[51] Int. Cl.[6] ..... F02N 11/00

[52] U.S. Cl. ..... 74/7 A; 74/7 E; 74/7 C

[58] Field of Search ..... 74/7 A, 6, 7 E, 74/7 C; 188/82.84; 335/282

[56] References Cited

U.S. PATENT DOCUMENTS 2,016,417 10/1935 Dyer ..... 74/7 A
4,488,054 12/1984 Ebihara ..... 74/7 A
5,222,401 6/1993 Fasola ..... 74/78
5,428,330 6/1995 Tamemoto ..... 335/236
5,443,553 8/1995 Shiga ..... 74/7 A

FOREIGN PATENT DOCUMENTS 447676 4/1948 Canada ..... 74/7 A
62-114430 7/1987 Japan .
614201 12/1948 United Kingdom .

*Primary Examiner*—Charles A. Marmor
*Assistant Examiner*—David M. Fenstermacher
*Attorney, Agent, or Firm*—Cushman, Darby & Cuahman IP Group of Pillsbury; Madison & Sutro LLP

[57] ABSTRACT

An attracting coil is directly wound on a non-magnetic heat-conductive sleeve and a plunger contacts the sleeve in a starter. An influence of heat generated through current flow to a motor and heat generated at the attracting coil through current flow to the attracting coil itself are transmitted and released from the attracting coil directly to the plunger. Therefore, decline of the attracting force of the attracting coil is prevented. A magnet switch is provided in the vicinity of the opposite end of a pinion of the motor. Thus, when the starter is mounted on an engine, the starter does not interfere with the engine and the mounting work is facilitated.

20 Claims, 17 Drawing Sheets

STARTER HAVING MAGNET SWITCH WITH HEAT DISSIPATION CHARACTERISTICS

BACKGROUND OF THE INVENTION

1. Field of the Invention

This invention relates to a starter for starting an engine.

2. Description of Related Art

One of the examples of a magnet switch for a starter is conventionally known as shown in FIG. 26 and is connected as shown in FIG. 27.

Reference numeral 1 is a magnet switch yoke having a cylindrical shape with a bottom, and at the center of the bottom, a through hole is arranged so that a plunger 12 can be moved therethrough in an axial direction. Reference numeral 2 is a bobbin made of resin and two kinds of coils, a holding coil 4 and an attracting coil 5, are wound around an outer periphery of bobbin 2. One end of holding coil 4 extends outside magnet switch yoke 1 and is connected to a load side of a terminal of a key switch 21 shown in FIG. 27. The other end is grounded to a stationary core 7. One end of attracting coil 5 is connected to the load side of the terminal of key switch 21 and the other end is connected to a positive side of a terminal of a starter motor 30. Reference numeral 6 is a belleville spring to fix bobbin 2 between magnet switch yoke 1 and stator core (stationary core) 7. Reference numeral 8 is a cap made of resin and is caulked and fixed with stationary core 7 via a packing 9 at a tip portion 1*a* of magnet switch yoke 1. Terminal bolts 10*a* and 10*b* are arranged on cap 8 and caulked onto cap 8 by a caulking washer 11. At the ends of terminal bolts 10*a* and 10*b* inside cap 8, fixed contacts 10*c* and 10*d* for contacting with a movable contact 15 are arranged. Terminal bolt 10*a* is electrically connected to a battery 31 shown in FIG. 27 via an electric cable. Terminal bolt 10*b* is electrically connected to motor 30 shown in FIG. 27 via an electric cable. The numbers of winding turn of holding coil 4 and attracting coil 5 are approximately the same and holding coil 4 is wound on an outer layer of attracting coil 5.

Reference numeral 3 is a nonmagnetic sleeve fitted into an inner circumference of bobbin 2. An engaging portion 13 to engage with a shift lever of a starter (not shown) is arranged at one end of plunger 12, and a plunger shaft 14 is arranged at the other end of plunger 12. Movable contact 15 is arranged on plunger shaft 14, and insulating washers 16 and 19 are arranged on faces of both ends of movable contact 15 to insulate movable contact 15 from plunger shaft 14. Movable contact 15, together with insulating washers 16 and 19, are loosely fitted on plunger shaft 14 to be slidable thereon. Reference numeral 18 is a snap ring fitted into a groove of the outer circumference of plunger shaft 14, and limits a movement of movable contact 15 in an axial direction. Reference numeral 17 is a contact spring pressing movable contact 15 in the direction of fixed contacts 10*c* and 10*d*, and is arranged between a stepped portion 14*a* of plunger shaft 14 and insulating washer 16. Reference numeral 20 is a plunger return spring to bias movable contact 15 away from fixed contacts 10*c* and 10*d*. While one end of the shift lever engages with engaging portion 13, the other end of the shift lever engages with a pinion which meshes with a ring gear of an engine (not shown) so that the pinion moves responsively to an operation of the shift lever.

An operation of the starter according to the above construction is explained next.

When holding coil 4 and attracting coil 5 are energized, plunger 12 is attracted toward stationary core 7, and the pinion is pushed out to contact the ring gear by the shift lever (not shown) engaged with engaging portion 13 which is arranged at one end of plunger 12. Plunger 12 is attracted further toward stationary core 7 so that movable contact 15 on plunger shaft 14 contacts fixed contacts 10*c* and 10*d*, and motor 30 is supplied with electricity for rotation. The rotation of motor 30 is transmitted to an over-running clutch, and the pinion engages the ring gear in order to start the engine.

At this point, an electric potential of fixed contact 10*d* almost equals a voltage of battery 31, therefore current flow to attracting coil 5 is stopped. Plunger 12 moves to stationary core 7 by a magnetomotive force of holding coil 4 only. Next, when the engine is started, the power supply to holding coil 4 is stopped and plunger 12 is parted away from the side of fixed contacts 10*c* and 10*d* by plunger return spring 20. The pinion is disengaged from the ring gear and, at the same time, movable contact 15 is disengaged from fixed contacts 10*c* and 10*d*. Then, the motor and the operation of the starter stop.

GB patent No. 614201 also discloses a conventional starter wherein a pinion meshes with a ring gear by way of having a rotation limiting member contacted with an outer circumferential portion of a clutch having the pinion, and shifting the pinion to the side of the ring gear by a friction between the rotation limiting member and the clutch. A magnet switch lets the rotation limiting member provided at a tip portion of the plunger contact with an outer circumference of the clutch and, at the same time, the magnet switch is supplied with power from a battery. As a result, a coil is energized and the plunger shifts by this energizing force. Thus the movable contact provided on the plunger contacts with fixed contacts to supply battery current to the motor.

However, in the former starter, the magnet switch is provided in parallel with the motor, and in the latter starter, the magnet switch is provided in the vicinity of the radial-directional outer circumference of the clutch. Therefore, a size of the starter in the radial direction becomes large and a mountability of the starter on the engine deteriorates.

Therefore, the inventors tried to provide the magnet switch in an opposite end of the pinion of the motor in order to downsize a starter in the radial direction.

However, when the magnet switch is provided in the vicinity of the opposite end of the pinion of the motor, the coil provided within the magnet switch receives an influence of heat generated through current flow to the motor and also the coil itself generates a heat due to current flow thereto. Therefore a resistance of the coil increases and the attracting force decreases.

Also in the former starter, since a large force is required to engage the pinion gear with the ring gear through the lever, the coil is needed to be constituted of an attracting coil and a holding coil. Therefore, it is necessary to keep a balance in currents flowing to the attracting coil and the holding coil. The attracting coil must be insulated from a sleeve for sure to avoid a short circuit between the attracting coil and the sleeve by a peeling-off of insulating coating of the attracting coil as a first layer coil due to vibrations, etc., since the short circuit causes a current imbalance. Therefore, the attracting coil should be either wound around a bobbin made of resin or wound on insulating material (such as insulating paper, insulating tape, etc.) on an outer circumference of the sleeve. However, the bobbin or insulating material is inferior in heat conductivity, it does not release the heat generated by the coil, the temperature of the coil itself rises and the resistance of the coil drastically increases. Furthermore, as described earlier, by the heat conduction to the coil of the motor in the case of providing the magnet switch in the vicinity of the opposite end of the pinion gear of the motor, the temperature of the coil further rises and the attracting force extremely decreases.

SUMMARY OF THE INVENTION

The primary object of the present invention is to provide a starter for solving the previously described problems of the related art.

The secondary object of the present invention is to provide a starter in which heat of an attracting coil is released as much as possible while maintaining a good mountability on an engine. Furthermore the heat is directly transmitted and released to a plunger via a sleeve in order to repress a decrease of an attracting force.

According to the first aspect of the present invention, a coil having insulating coating is directly wound around a non-magnetic sleeve having heat conductivity. Influence of heat generated by current flow to a starter motor and heat generated by current flow to the coil are directly transmitted to a plunger contacting the sleeve which has heat conductivity so that the heat is released and the decrease of the attracting force is repressed. Since a magnet switch is provided in the vicinity of an opposite end of a pinion of a starter motor, a starter does not interfere with an engine and mounting work is facilitated when the starter is to be fitted onto the engine.

Preferably, the magnet switch has a magnet switch yoke made of magnetic material having a bottomed cylindrical shape, in which a coil is provided in an inner circumference thereof, and has a stator core made of magnetic material closing an opening portion of the magnet switch yoke. The sleeve contacts either the stator core or the magnet switch yoke.

Preferably, the sleeve is made by rolling a metal plate connected at a seam where each contact face is connected. The sleeve itself has an elasticity due to a spring-back function in the radial direction, the coil wound around the outer circumference of the sleeve becomes loose-resistant. Thus, the coil and the sleeve contact so tight that the heat is transmitted to the sleeve efficiently.

According to the second aspect of the present invention, a coil having insulating coating is directly wound around a sleeve of non-magnetic material having heat conductivity and a magnet switch is arranged in the vicinity of the opposite end of a pinion of a starter motor. Further, a single coil will suffice for shifting the pinion to the side of ring gear by limiting a rotation by a rotation limiting member. Under the condition that one end portion of the coil is grounded and the coil is directly wound around the sleeve from this end portion, for example, even when the first layer of the coil is short-circuited to the sleeve and the number of turns of the coil is substantially decreased, current flow increases in accordance with a decrease in the resistance value. Therefore, an attracting force determined by the current x the number of turns (the number of windings of the coil) does not vary largely. In other words, the attracting force does not vary and is enough to function the rotation limiting member. Therefore, there is no need to give a special insulating treatment onto the sleeve when the coil is wound around the outer circumference of the sleeve. Thus, the cost reduction is achieved.

DETAILED DESCRIPTION OF THE PREFERRED EMBODIMENTS

Figure 1:
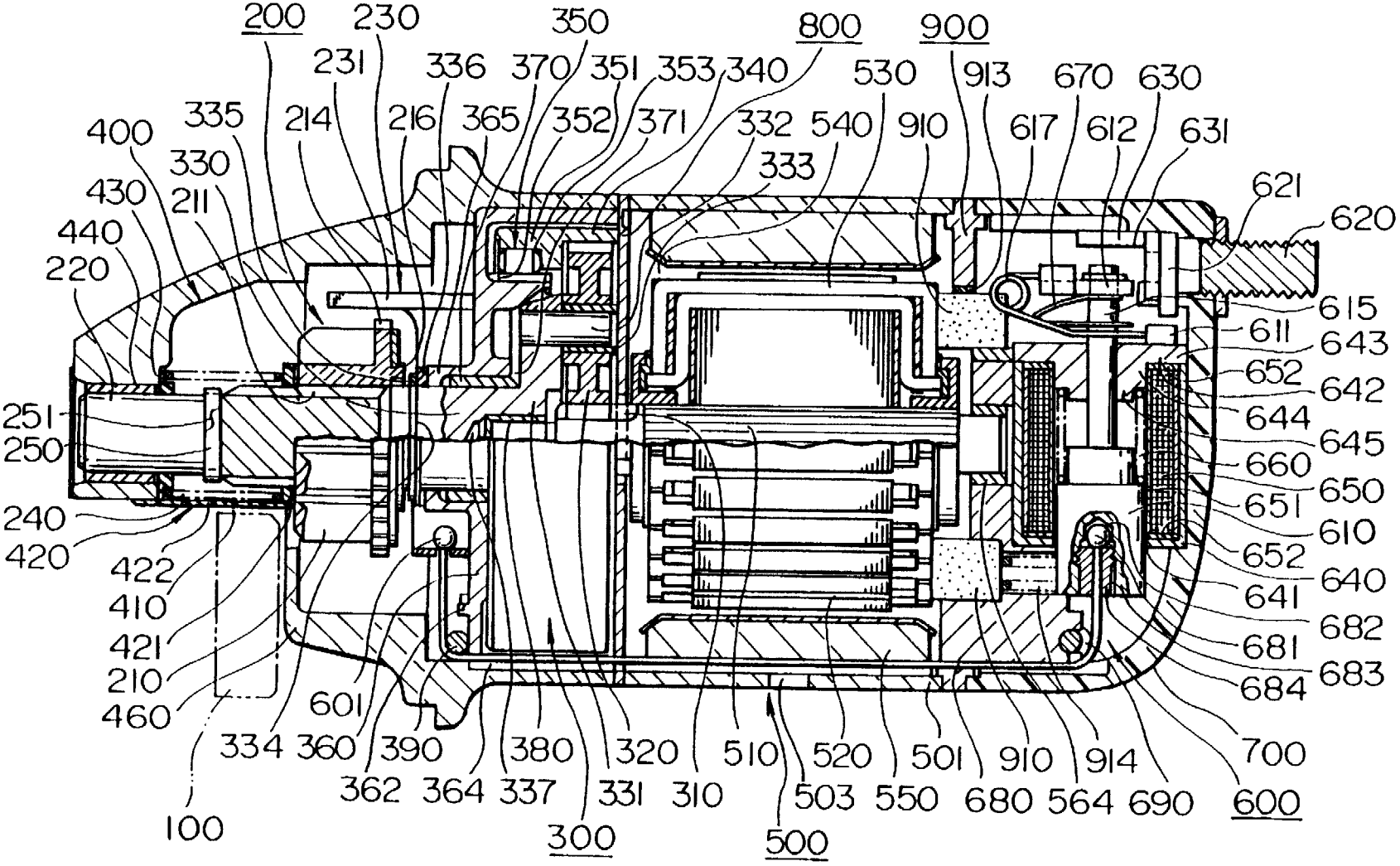
FIG. 1 is a cross-sectional side view showing a starter of the present invention.

A starter according to the present invention will be described based on embodiments shown in FIG. 1 through FIG. 25.

The starter can be generally divided into housing 400 containing pinion 200 which meshes with ring gear 100 mounted on an engine and planetary gear mechanism 300. The starter further includes motor 500, and end frame 700 containing magnet switch 600. Inside the starter, housing 400 and motor 500 are separated by motor spacer wall 800, and motor 500 and end frame 700 are separated by brush holding member 900.

(Pinion 200)

Figure 3A:
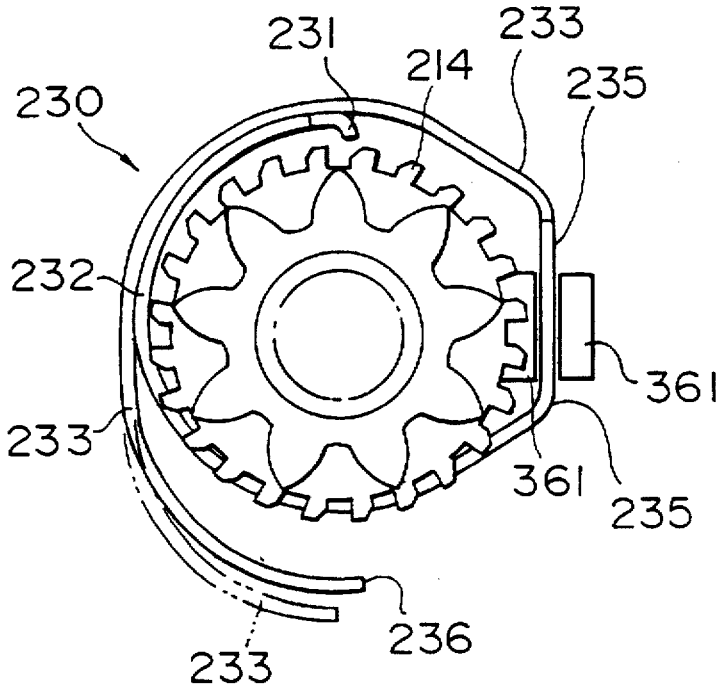
FIGS. 3A and 3B are a front view and a partial sectional side view of the rotation limiting member fitted to a pinion part, respectively.
Figure 3B:
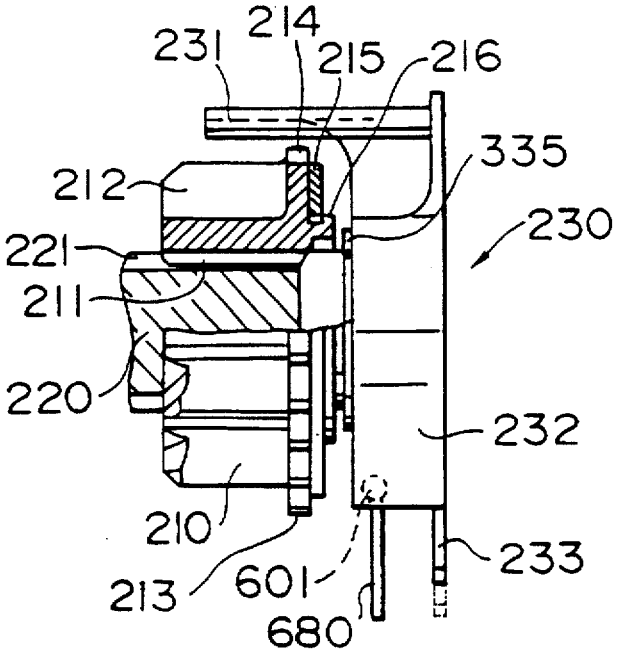

As shown in FIGS. 1, 3A and 3B, pinion gear 210 which meshes with ring gear 100 of the engine is formed on pinion 200 (pinion shifting member in the present invention).

Pinion helical spline 211 which mates with helical spline 221 formed on output shaft 220 is formed around the inner surface of pinion gear 210.

On the side of pinion gear 210 opposite from ring gear 100, flange 213 of greater diameter than the external diameter dimension of pinion gear 210 is formed in circular form. The number of projections 214 greater than the number of outer teeth of pinion gear 210 are formed around the entire outer circumference of flange 213. Projections 214 are for limiting claw 231 of pinion rotation limiting member 230, which will be discussed below, to mate with. Washer 215 is bent onto the outer peripheral side of annular portion 216 formed on the rear end of pinion gear 210 and is thereby disposed rotatably and unable to come off in the axial direction at the rear surface of flange 213.

On the other hand, pinion gear 210 is urged toward the rear of output shaft 220 at all times by return spring 240 consisting of a compression coil spring. Return spring 240 does not urge pinion gear 210 directly but in this embodiment urges pinion gear 210 by way of ring body 421 of shutter 420, which opens and closes opening portion 410 of housing 400 and will be further discussed below.

In this embodiment, pinion 200 is the pinion shifting member of the present invention, however, the pinion shifting member can be a one-way directional clutch having pinion 200.

(Rotation Limiting Member 230)

Figure 2:
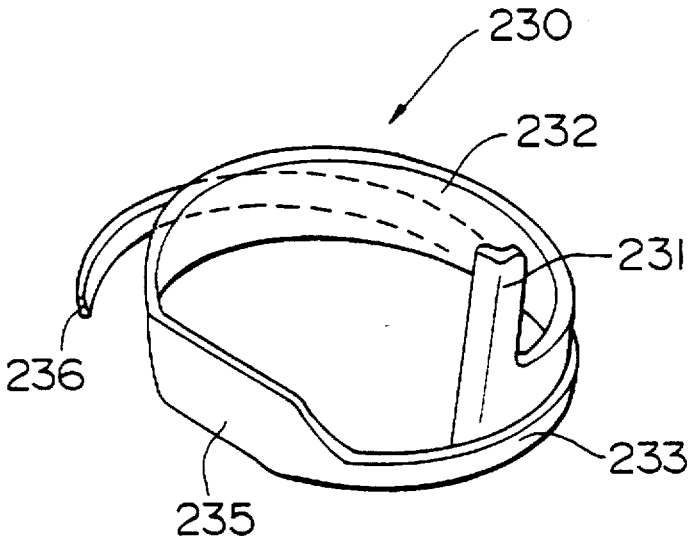
FIG. 2 is a perspective view of a rotation limiting member.

Rotation limiting member 230, as shown in FIGS. 2, 3A and 3B, is a sheet spring member wound through approximately 1 and ½ turns of which approximately ¾ turn is rotation limiting portion 232 of long axial sheet length and high spring constant and the remaining approximately ¾ turn is return spring portion 233 constituting urging means of short axial sheet length and low spring constant.

Limiting claw 231 which constitutes a limiting portion extending in the axial direction and which mates with multiple projections 214 formed in flange 213 of pinion gear 210, is formed at one end of rotation limiting portion 232. Limiting claw 231 is mating with projections 214 of pinion gear 210 is formed to have an axially long length in order to increase the rigidity of limiting claw 231, and is bent radially inward into a cross-sectional L-shape. (That is, limiting claw 231 is bar-shaped.)

Rotation limiting portion 232 is provided with a straight portion 235 which extends vertically. Straight portion 235 is vertically slidably supported by two supporting arms 361 mounted projecting from the front surface of center bracket 360. That is, straight portion 235, which moves vertically, causes rotation limiting portion 232 to move vertically also.

Also, sphere 601 of the front end of cord-shaped member 680 (e.g., a wire) which will be described below, for transmitting the movement of magnet switch 600, also described below, is in engagement with the lower end of the curvature halfway of the rotation limiting portion 232. (The position 180° opposite the limiting claw 231.)

The end portion side of return spring portion 233 has a large curvature of winding and one end portion 236 of return spring portion 233 abuts the upper surface of limiting shelf 362 mounted projecting from a front surface of a lower portion of center bracket 360.

The operation of rotation limiting member 230 will be explained. Cord-shaped member 680 serves as the transmitting means for transmitting a movement of magnet switch 600 to limiting claw 231. The movement of magnet switch 600 pulls rotation limiting portion 232 downward and causes limiting claw 231 to engage with projections 214 on flange 213 of pinion gear 210. At that time, because end portion 236 of return spring portion 233 is in abutment with limiting shelf 362 for position limiting, return spring portion 233 bends. Because limiting claw 231 is in engagement with projections 214 of pinion gear 210, when pinion gear 210 starts rotation through armature shaft 510 of motor 500 and planetary gear mechanism 300, pinion gear 210 advances along helical spline 221 of output shaft 220. When pinion gear 210 abuts ring gear 100 and the advance of pinion gear 210 is obstructed, further rotational force of output shaft 220 causes rotation limiting member 230 itself to bend and pinion gear 210 rotates slightly and meshes with ring gear 100. When pinion gear 210 advances, limiting claw 231 disengages from projections 214 and then drops in behind flange 213 of pinion gear 210. The front end of limiting claw 231 abuts the rear surface of washer 215 and pinion gear 210 is prevented from receiving the rotation of ring gear 100 of the engine and retreating.

As the movement of magnet switch 600 stops, cord-shaped member 680 stops pulling rotation limiting portion 232 downward, at the same time, the action of return spring portion 233 causes rotation limiting portion 232 to return to its original position.

Because rotation limiting member 230 need only be held with a small force required to simply limit the rotation of pinion gear 210, it is possible to move pinion limiting member 230 to the side of pinion gear 210 by means of magnet switch 600, using cord-shaped member 680. Consequently, it is possible to increase the freedom of position where magnet switch 600 is disposed.

(Pinion Stopping Ring 250)

Pinion stopping ring 250 is fixed in a circular groove of rectangular cross-section formed around output shaft 220. Pinion stopping ring 250 is a piece of steel of rectangular cross-section processed into a circular shape, substantially S-shaped corrugation 251 (e.g., an engaging means), is formed at each end, and one of the convex portions engages with a concave portion of the other end and a convex portion of the other end engages with a concave portion of the first end. (Planetary Gear Mechanism 300)

Planetary gear mechanism 300, as shown in FIG. 1, is a speed reducing means for reducing the rotational speed of motor 500, which will be explained below, in order to increase an output torque of motor 500. Planetary gear mechanism 300 is made up of sun gear 310 formed on the front-side outer periphery of armature shaft 510 (discussed below) of motor 500, a plurality of planetary gears 320 which mesh with sun gear 310 and rotate around the circumference of sun gear 310, planet carrier 330 which rotatably supports these planetary gears 320 around sun gear 310 and is formed integrally with output shaft 220, and an internal gear 340 which is of a cylindrical shape meshing with planetary gears 320 at the outer periphery of planetary gears 320 and is made of resin.

(Overrunning Clutch 350)

Overrunning clutch 350 is supported in a way that internal gear 340 is rotatable in one direction only (i.e., only in the direction in which it rotates under the rotation of the engine). Overrunning clutch 350 has clutch outer member 351 constituting a first cylindrical portion formed in the front side of internal gear 340, circular clutch inner member 352 constituting a second cylindrical portion formed in the rear surface of center bracket 360 constituting a fixed side covering the front of planetary gear mechanism 300 and disposed facing the inner circumference of clutch outer member 351, and rollers 353 accommodated in a roller housing portion formed inclined to the inner surface of clutch outer member 351.

Because overrunning clutch 350 uses center bracket 360, which rotatably supports output shaft 220 by way of bearing 370, the axial length need not be made long and downsizing of the starter of the present invention is achieved.

(Center Bracket 360)

Figure 4:
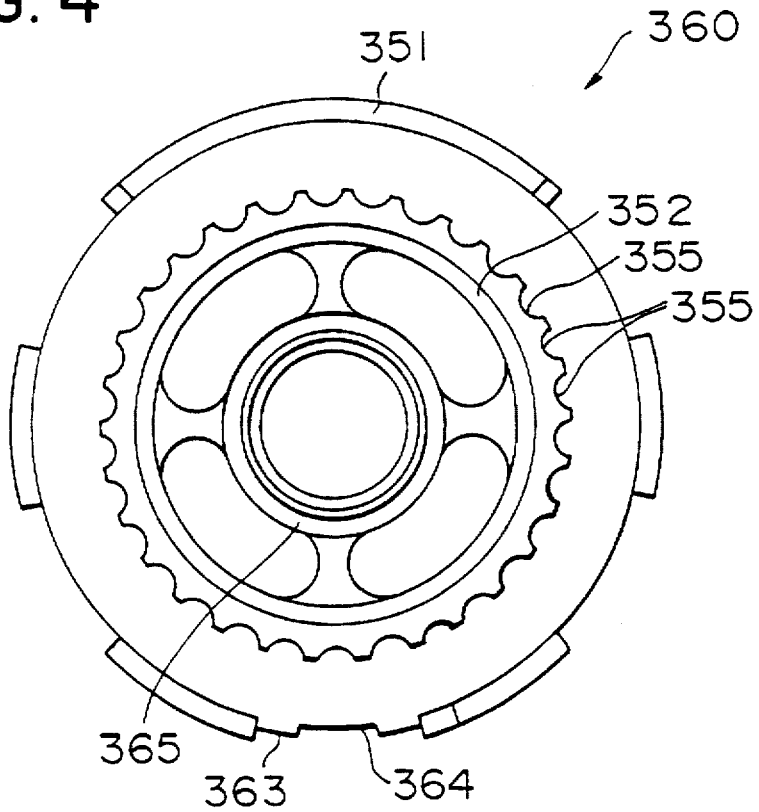
FIG. 4 is a rear view of a center bracket.
Figure 5:
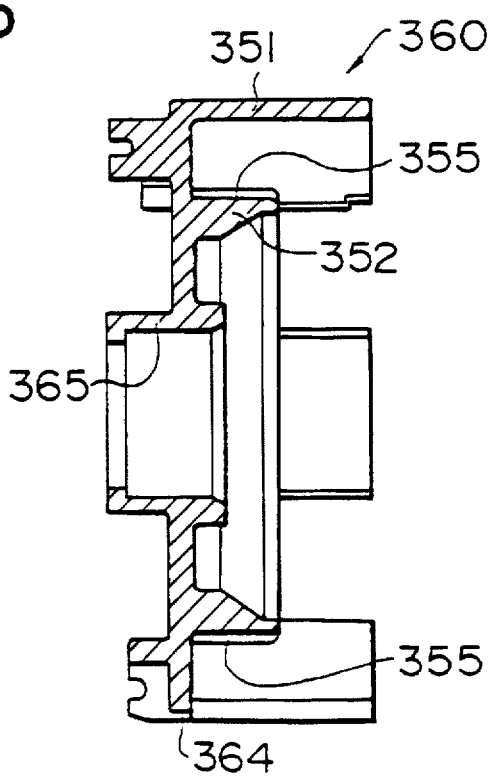
FIG. 5 is a sectional side view of the center bracket.
Figure 6:
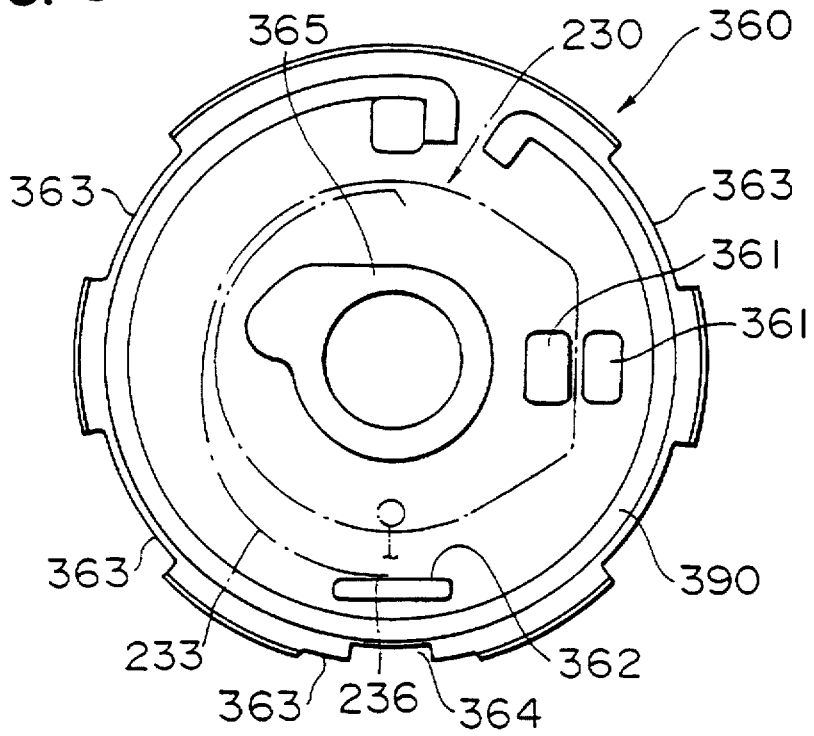
FIG. 6 is a front view of the center bracket.

Center bracket 360 is shown in FIGS. 4 through 6 and is disposed inside the rear end of housing 400. Housing 400 and center bracket 360 are linked by ring spring 390 having one end engaged with housing 400 and the other end engaged with center bracket 360. Further, housing 400 and center bracket 360 are disposed in such a manner that the rotational reaction received by clutch inner member 352, which forms part of overrunning clutch 350, is absorbed by ring spring 390 and the reaction is not directly transmitted to housing 400.

Two supporting arms 361 which hold pinion rotation limiting member 230 and limiting shelf 362 on which the lower end of pinion rotation limiting member 230 is loaded are mounted on the front surface of center bracket 360. Further, a plurality of cutout portions 363 which mate with convex portions (not illustrated) on the inner side of housing 400 are formed around center bracket 360. The upper side cutout portions 363 are also used as air passages for guiding air from inside housing 400 into yoke 501. Also, concave portion 364 through which cord-shaped member 680 (discussed below) passes in the axial direction is formed at the lower end of center bracket 360.

Planet carrier 330 is provided at its rear end with flange-like projecting portion 331 which extends diametrally radially in order to support planetary gears 320. Pins 332 extending rearward are fixed to flange-like projecting portion 331 and rotatably support planetary gears 320 by way of metal bearings 333.

Planet carrier 330 has its front end rotatably supported by housing bearing 440 fixed inside the front end of housing 400 and center bracket bearing 370 fixed inside inner cylindrical portion 365 of center bracket 360.

Planet carrier 330 includes circular groove 334 at a front end position of inner cylindrical portion 365, and stopping ring 335 mated with circular groove 334. Between stopping ring 335 and the front end of inner cylindrical portion 365, washer 336 is rotatably mounted with respect to planet carrier 330. By stopping ring 335 abutting the front end of inner cylindrical portion 365 by way of washer 336, rearward movement of planet carrier 330 is limited. The rear end of center bracket bearing 370, which supports the rear side of planet carrier 330 has a flange portion 371 sandwiched between the rear end of inner cylindrical portion 365 and flange-like projecting portion 331. Because flange-like projecting portion 331 abuts the rear end of inner cylindrical portion 365 by way of flange portion 371, forward movement of planet carrier 330 is limited.

Concave portion 337, which extends axially, is provided in the rear surface of planet carrier 330, and the front end of armature shaft 510 is rotatably supported by way of planet carrier bearing 380 disposed in concave portion 337.

(Housing 400)

Housing 400 supports output shaft 220 through housing bearing 440 fixed in the front end of housing 400. Further, housing 400 is provided with water barrier wall 460, which minimizes the gap at the lower part of opening portion 410 between the outer diameter of pinion gear 210 and housing 400 in order to minimize the unwanted entering of rainwater and the like therethrough. Also, two slide grooves 450, which extend axially, are provided at the lower part of the front end of housing 400 and shutter 420, which will be described below, is disposed in slide grooves 450.

(Shutter 420)

The operation of shutter 420 is such that when the starter begins operation, and pinion gear 210 shifts forward along output shaft 220, ring body 421 shifts forward together with pinion gear 210. When this happens, water-barrier portion 422, which is integral with ring body 421, shifts forward and opens opening portion 410 of housing 400. When the starter stops operating and pinion gear 210 shifts backward along output shaft 220, ring body 421 also shifts backward together with pinion gear 210. When this happens, water-barrier portion 422, which is integral with ring body 421, also shifts backward and closes opening portion 410 of housing 400. As a result, shutter 420, which constitutes opening and closing means, by means of the water-barrier portion 422, prevents rainwater and the like, which is splashed by the centrifugal force of ring gear 100, from entering housing 400 when the starter is not in operation.

(Seal Member 430)

Seal member 430 seals around output shaft 220 and prevents rainwater, dust, and the like, which have entered through opening portion 410 of housing 400, from entering housing bearing 440 in the front end of housing 400.

(Motor 500)

Motor 500 is made up of and is enclosed by yoke 501, motor spacer wall 800, and brush holding member 900, which will be described below. Motor spacer wall 800 houses planetary gear mechanism 300 between itself and center bracket 360, and fulfills the role of preventing lubricating oil inside the planetary gear mechanism 300 from entering into motor 500.

Motor 500, as shown in FIG. 1, is made up of armature 540 comprising armature shaft 510, armature core 520 and armature coils 530 which are mounted on armature shaft 510 and rotate integrally with, and fixed poles 550 to rotate armature 540. Fixed poles 550 are fixed on the inner circumference of yoke 501.

(Armature Shaft 510)

Armature shaft 510 is rotatably supported by planet carrier bearing 380 inside the rear portion of planet carrier 330 and brush holding member bearing 564 mounted on the inner circumference of brush holding member 900. The front end of armature shaft 510 passes into the inside of planetary gear mechanism 300, and as described above sun gear 310 of planetary gear mechanism 300 is formed on the outer periphery of the front end of armature shaft 510.

(Armature Coil 530)

In this embodiment, armature coils 530 having a plurality of (e.g., twenty-five) upper layer coil bars 531 and an equal number of lower layer coil bars 532 are used. Two-layer-winding coils wherein the respective upper layer coil bars 531 and lower layer coil bars 532 are stacked in the radial direction are employed. Each upper layer coil bar 531 and each lower layer coil bar 532 are paired, and the ends of upper layer coil bars 531 and the ends of lower layer coil bars 532 are electrically connected to constitute ring-shaped coils.

(Upper Layer Coil Bars 531)

Upper layer coil bars 531 are made of a material having excellent electrical conductivity (e.g., copper) and each is provided with upper layer coil arm 533 which extends axially in parallel with fixed poles 550 and is held in the outer sides of slots 524 and two upper layer coil ends 534, which are bent inward from both ends of upper layer coil arm 533, extend axially in a direction orthogonal to the axial direction of armature shaft 510. Upper layer coil arm 533 and two upper layer coil ends 534 may be a member integrally molded by cold casting, may be a member shaped by bending in a press into a U-shape, or may be a member formed by joining an upper layer coil arm 533 and two upper layer coil ends 534 made as separate parts by a joining method such as welding.

Figure 8:
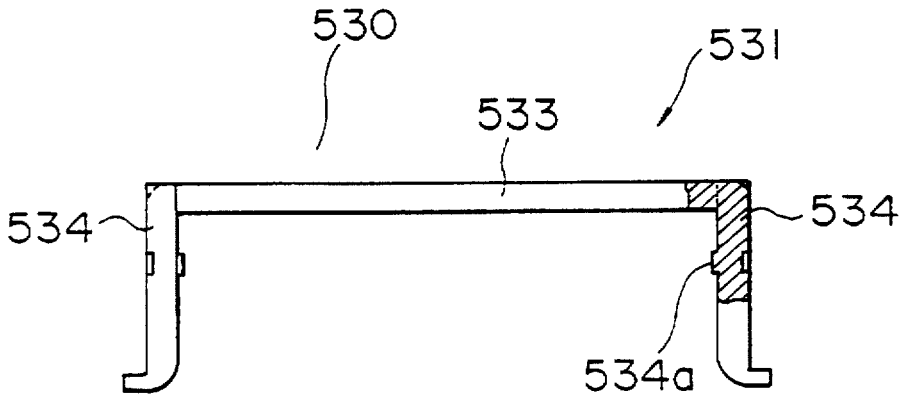
FIG. 8 is a side view of the upper coil bar.
Figure 9:
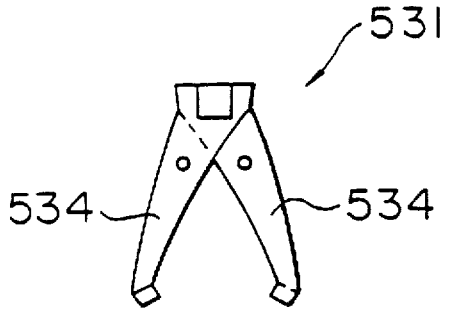
FIG. 9 is a front view of the upper coil bar.
Figure 10:
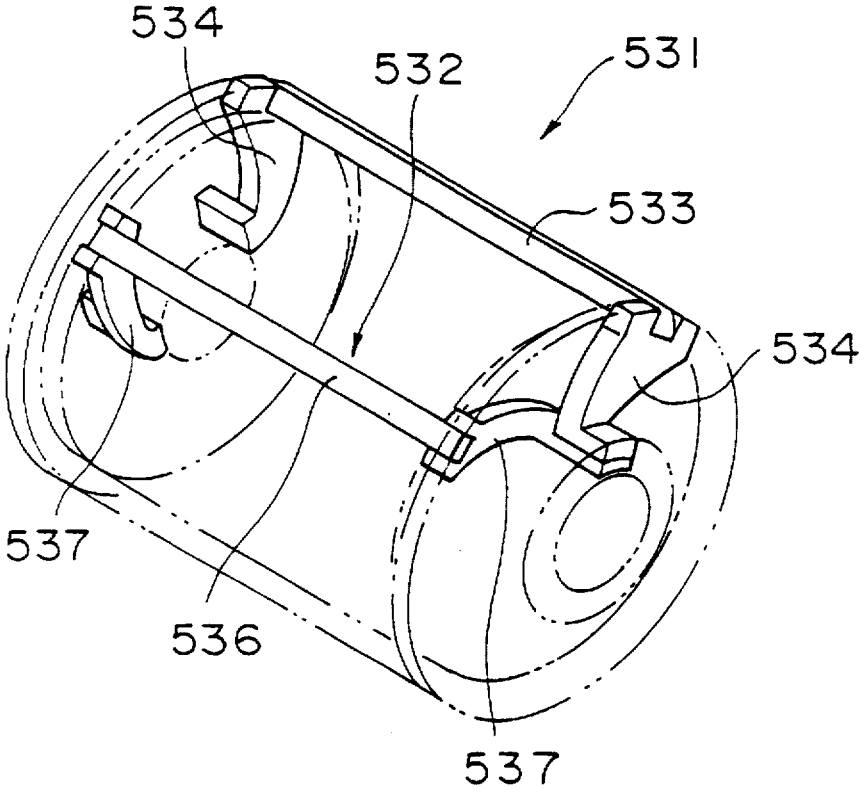
FIG. 10 is a schematic perspective view showing arrangement of the upper coil bar and a lower coil bar.
Figure 11:
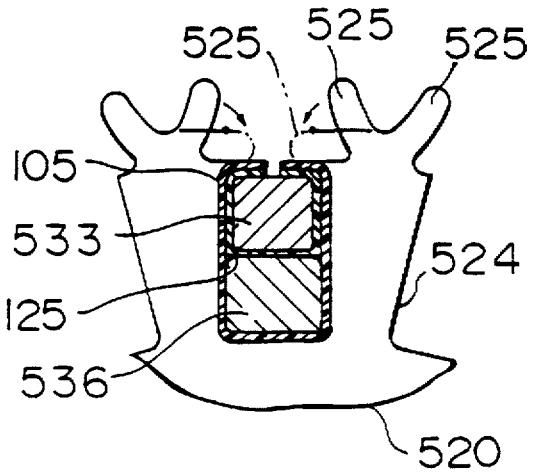
FIG. 11 is a sectional view of an upper coil arm and a lower coil arm received in a slot.

Upper layer coil arm 533, as shown in FIGS. 8 through 10, is a straight bar having a rectangular cross-section and, as shown in FIG. 11, has its periphery covered with an upper layer insulating film 125 (e.g., a resin thin film such as nylon, or paper), is firmly received in slots 524 together with lower layer coil arm 536 which will be described below.

As shown in FIG. 10, of the two upper layer coil ends 534, one upper layer coil end 534 is mounted slanting forward with respect to the direction of rotation and the other upper layer coil end 534 is mounted slanting rearward with respect to the direction of rotation. The angles of slant of the two upper layer coil ends 534 with respect to the radial direction are the same angles of slant with respect to upper layer coil arm 533, and the two upper layer coil ends 534 are of identical shape. As a result, even when upper layer coil bar 531 is reversed through 180°, upper layer coil bar 531 has the same shape as before it was reversed. In other words, because there is no distinction between the two upper layer coil ends 534, the workability when mounting upper layer coil bar 531 to armature core 520 is excellent.

Of the two upper layer coil ends 534, upper layer coil end 534 disposed on the side of magnet switch 600 directly abuts brush 910 which will be described below and passes electrical current to armature coils 530. Therefore, at least the surface of upper layer coil end 534 with which brush 910 abuts is processed to be smooth. In the starter of this embodiment, it is not necessary to provide an independent commutator to conduct electrical current to armature coils 530. Because the independent commutator becomes unnecessary, it is possible to reduce the number of components and reduce the number of processes entailed in manufacturing the starter, and the production cost can be decreased. Also, because the need to dispose the independent commutator inside the starter is eliminated, the starter can be made compact in the axial direction.

(Lower Layer Coil Bars 532)

Lower layer coil bars 532, like upper coil bars 531, are made from a material having excellent electrical conductivity (e.g., copper). Each lower layer coil bar 532 comprises lower layer coil arm 536 which extends in parallel with respect to fixed poles 550 and is held in the inner sides of slots 524 and two lower layer coil ends 537 which are bent inward from the ends of lower layer coil arm 536 and extend orthogonally to the axial direction of armature shaft 510. Lower layer coil arm 536 and two lower layer coil ends 537, like upper layer coil bar 531, may be a member integrally molded by cold casting, may be a member shaped by bending in a press into a U-shape, or may be a member formed by joining lower layer coil arm 536 and two lower layer coil ends 537 made as separate parts by a joining method such as welding.

Insulation between upper layer coil ends 534 and lower layer coil ends 537 is secured by an insulating spacer 560 and insulation between lower layer coil ends 537 and armature core 520 is secured by an insulating ring 590 made of resin (e.g., nylon or phenol resin).

Figure 7:
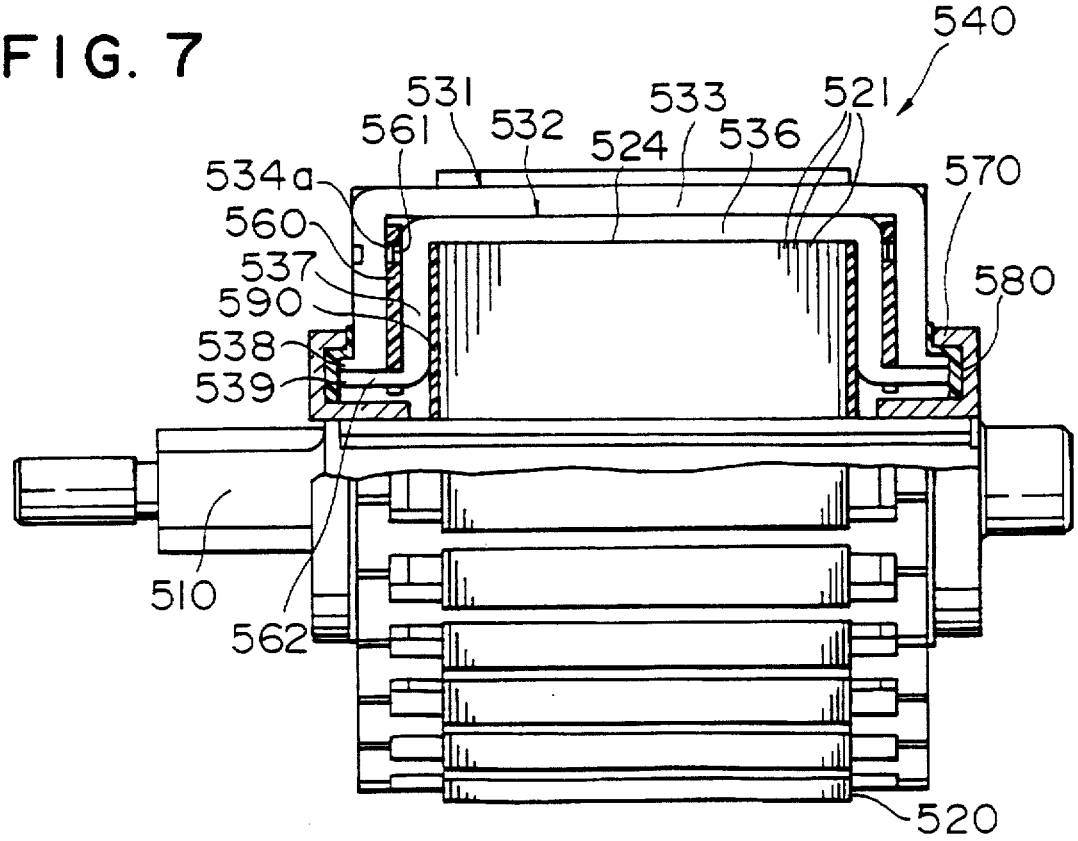
FIG. 7 is a sectional side view of an armature.

Lower layer coil arm 536, as shown in FIGS. 8 and 11, is a straight bar of rectangular cross-section and, as shown in FIG. 7, is firmly received in slots 524 together with upper layer coil arm 533. The lower layer coil arm 536 is covered with a lower insulating film (e.g., nylon or paper) and is received in slots 524 together with upper layer coil arm 533 covered with the upper insulating film.

The inner end portions of lower layer coil ends 537 at both ends are provided with lower layer inner extension portions 539 extending axially. The outer peripheral surfaces of lower layer inner extension portions 539 mate with concave portions 561 formed in inner peripheries of insulating spacers 560 and overlap with and are electrically and mechanically connected by a joining method such as welding to the inner peripheries of upper layer inner extension portions 538 of the end portions of upper layer coil ends 534. The inner peripheries of lower layer inner extension portions 539 are disposed clear of and insulated from armature shaft 510.

The inner ends of the two upper layer coil ends 534 are provided with upper layer inner extension portions 538 extending axially. The inner peripheral surfaces of these upper layer inner extension portions 538 overlap with and are electrically and mechanically connected by a joining method such as welding to the outer peripheries of lower layer inner extension portions 539 of the inner ends of lower layer coil bars 532 discussed above. The outer peripheral surfaces of the upper layer inner extension portions 538 abut via insulating caps 580 with the inner surface of outer circular portion 571 of fixing member 570 press-fixed to armature 510.

(Insulating Spacer 560)

Figure 12:
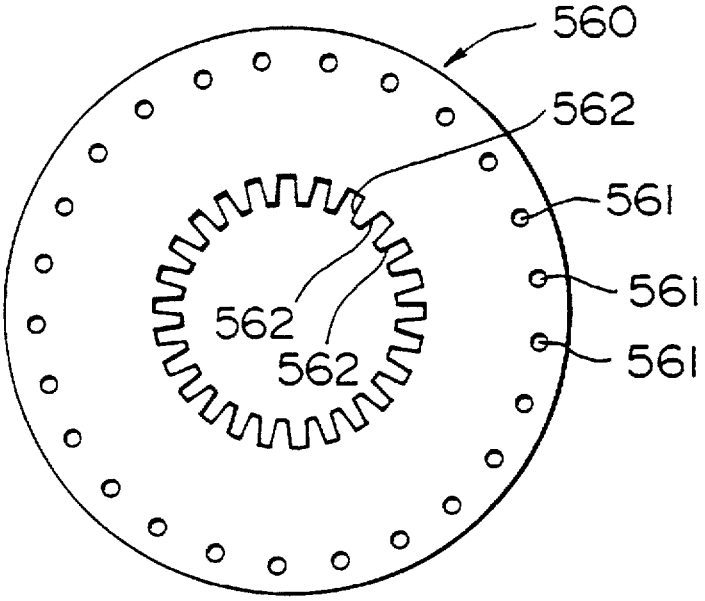
FIG. 12 is a front view of an insulating spacer.

Insulating spacers 560 are thin plate rings made of resin, e.g., epoxy resin, phenol resin, or nylon. Spacers 560, as shown in FIG. 12, have a plurality of holes 561 with which projections 534*a* of upper layer coil ends 534 mate, and are formed in the outer peripheral sides thereof. Concave portions 562 with which lower layer inner extension portions 539 on the inner sides of lower layer coil ends 537 are mated are formed at the inner periphery of insulating spacers 560. Holes 561 and concave portions 562 of insulating spacers 560, as will be described below, are used for positioning and fixing armature coils 530.

(Fixing Member 570)

Figure 13:
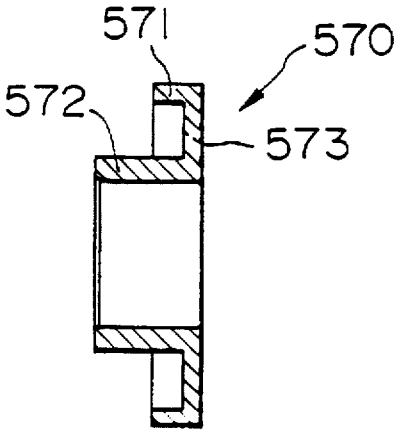
FIG. 13 is a sectional side view of a fixing member.
Figure 14:
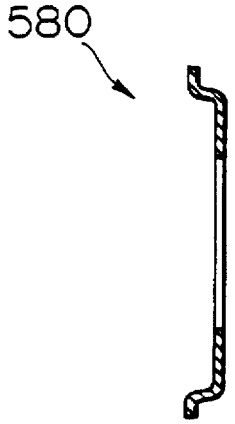
FIG. 14 is a front view of an insulating cap.

Fixing members 570, as shown in FIG. 13, each comprises inner circular portion 572 press-fitted on armature shaft 510, limiting ring 573 extending perpendicularly to the axial direction for preventing upper layer coil ends 534 and lower layer coil ends 537 from spreading axially, and outer circular portion 571 which encloses upper layer inner extension portions 538 of upper layer coil ends 534 and prevents the inner diameters of armature coils 530 from spreading due to centrifugal force. In order to secure insulation between fixing members 570 and upper layer coil ends 534 and lower layer coil ends 537, fixing members 570 have disc-shaped insulating caps 580 shown in FIG. 14 made of resin, e.g., nylon, interposed therebetween.

In armature 540, because upper layer coil ends 534 at the ends of upper layer coil bars 531 which constitute armature coils 530 and lower layer coil ends 537 at the ends of lower layer coil bars 532 are all mounted orthogonally to the axial direction of armature shaft 510 and consequently the axial dimension of armature 540 can be made short, the axial dimension of the motor 500 can also be made short, and as a result the starter can be made more compact than in the conventional starters.

In this embodiment, because magnet switch 600 is disposed in the space resulting from shortening of the axial dimension of motor 500 and the shortening space created by dispensing with independent commutators, although compared with conventional starters the axial directional dimension is not much different, but because the space occupied by magnet switch 600 which has conventionally been mounted above motor 500 becomes unnecessary, the volume occupied by the starter can be made considerably smaller than in the conventional starters.

(Fixed Poles 550)

Figure 15:
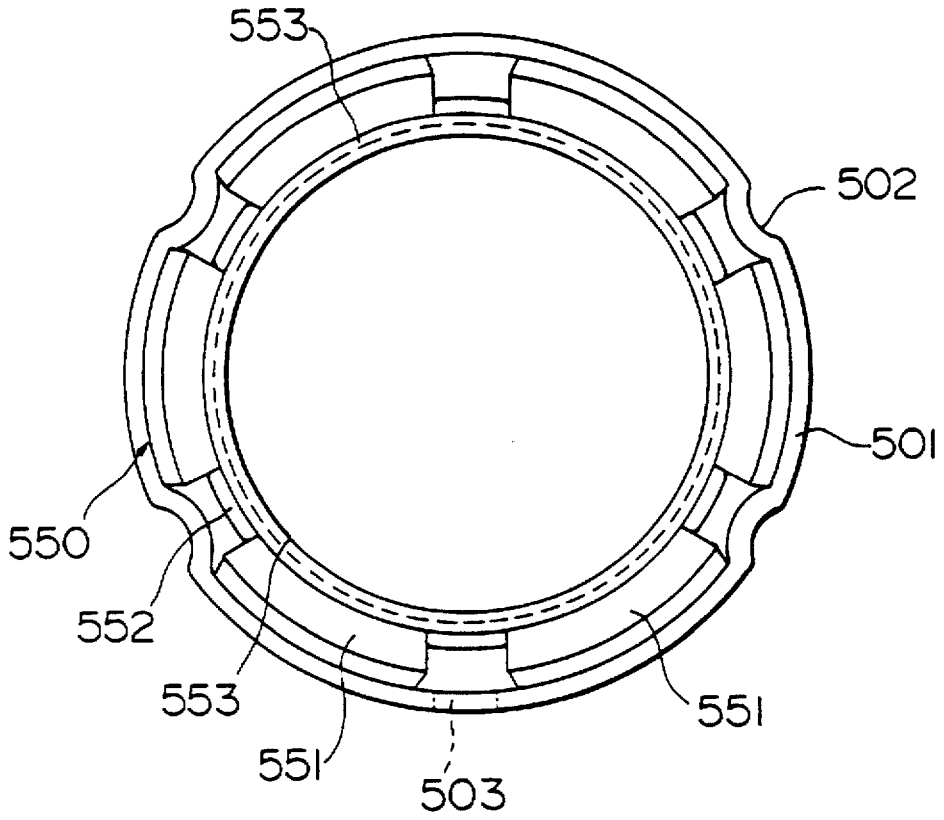
FIG. 15 is a sectional side view of a yoke.

In this embodiment permanent magnets are used for fixed poles 550 and, as shown in FIG. 15, fixed poles 550 comprise a plurality of (e.g., six) main poles 551 and inter-pole poles 552 disposed between main poles 551. Field coils which generate magnetic force by electrical current flow may be used instead of permanent magnets as fixed poles 550.

Main poles. 551 are positioned by the ends of the inner sides of channel grooves 502 in yoke 501, and are fixed in yoke 501 by fixing sleeves 553 disposed around the inner circumference of fixed poles 550 with inter-pole poles 552 disposed between main poles 551.

(Magnet Switch 600)

Figure 16:
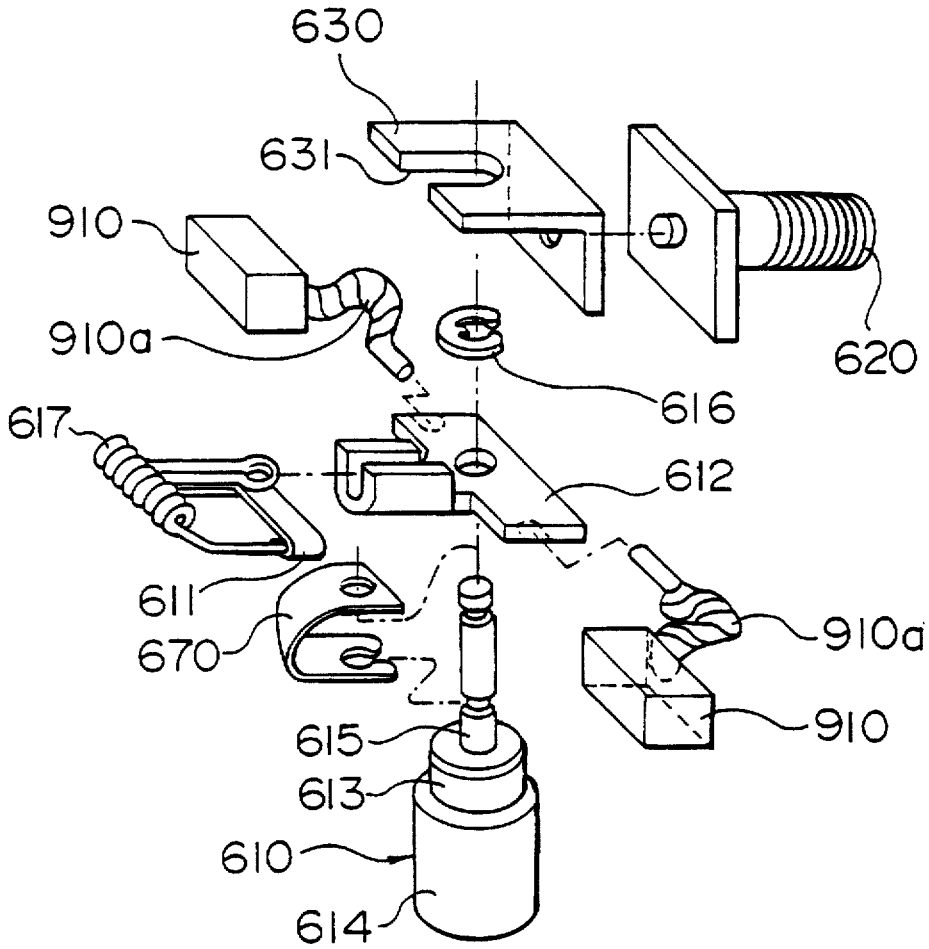
FIG. 16 is an exploded perspective view of a plunger and fixed contacts of a magnet switch.
Figure 17:
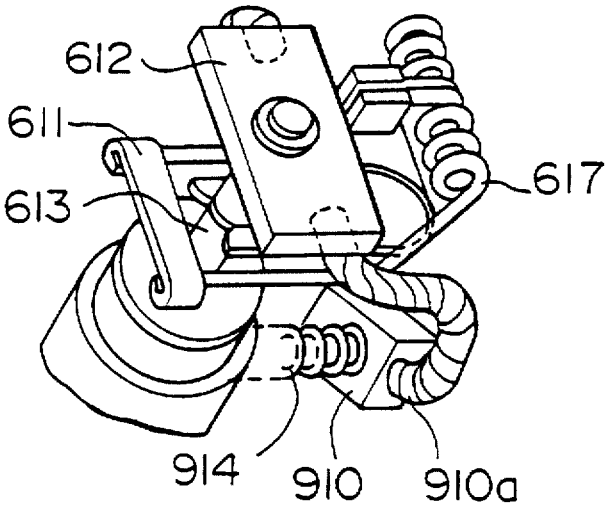
FIG. 17 is a perspective view showing a plunger of the magnet switch.

Magnet switch 600, as shown in FIGS. 1, 16, and 17, is held in brush holding member 900, which will be described below, and is disposed inside end frame 700, also described below, and is fixed so as to be roughly orthogonal to armature shaft 510. In other words, magnet switch 600 is provided in the vicinity of the opposite end of pinion gear 210 of motor 500.

In magnet switch 600, electrical current drives plunger 610 upward, and two contacts (lower movable contact 611 and upper movable contact 612), which move together with plunger 610 are sequentially caused to abut head 621 of terminal bolt 620 and an abutting portion 631 of fixed contact 630. A battery cable (not illustrated) is connected to terminal bolt 620.

Magnet switch 600 is structured inside magnet switch yoke 640 which is in cylindrical shape having a bottom and is made of highly heat-conductive magnetic material (e.g., iron). Magnet switch yoke 640 is, for example, a pliable soft steel plate press-formed into a cup shape, and in the center of the bottom of magnet switch yoke 640, hole 641 is formed so that plunger 610 passes movably in the vertical direction. Also, the upper opening of magnet switch yoke 640 is closed off by stationary core 642 made of a highly heat-conductive magnetic body (e.g., iron).

Stationary core 642 consists of upper large diameter portion 643, lower middle diameter portion 644, and still lower small diameter portion 645. Further, stationary core 642 is fixed in the upper opening of magnet switch yoke 640 by the outer periphery of large diameter portion 643 by caulking the inner side of the upper end of magnet switch yoke 640. The upper end of attracting coil 650 is fitted around middle diameter portion 644. The upper end of compression coil spring 660 which urges the plunger 610 downward is fitted around the periphery of small diameter portion 645 of stationary core 642.

Attracting coil 650 is an attracting means that generates magnetic force when a current flows therethrough and attracts plunger 610. Attracting coil 650 is provided with sleeve 651 which has its upper end fit to middle diameter portion 644 of stationary core 642 and covers plunger 610 slidably in the vertical direction. Sleeve 651 is made by rolling up a superior heat-conductive nonmagnetic thin plate (e.g., a copper, brass, or stainless steel plate). Insulating washers 652*a* and 652*b* made of resin or the like are provided at the upper and lower ends of sleeve 651.

The exciting coil conventionally formed of an attracting coil and a holding coil is replaced with a single coil of attracting coil 650 in this embodiment.

Figure 23:
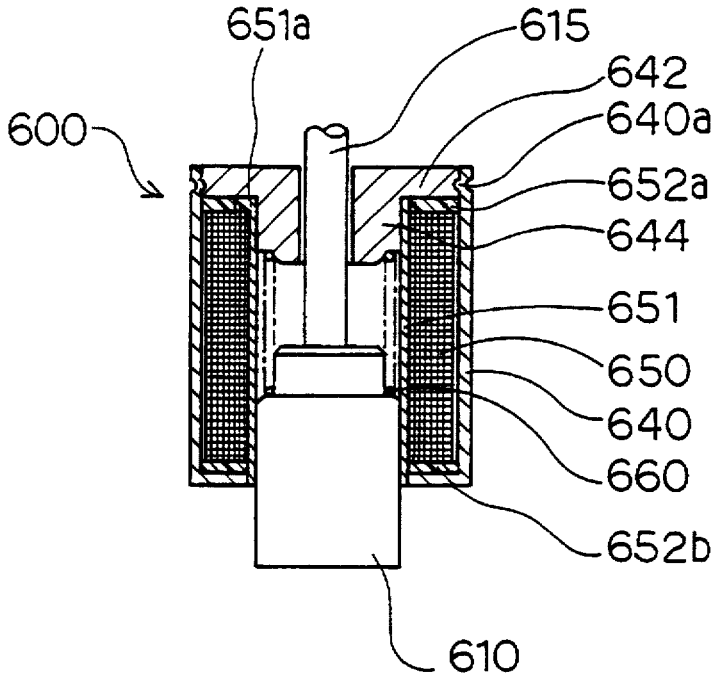
FIG. 23 is a sectional view of a major part of the magnet switch for the starter according to the present invention shown in FIG. 1.

The starter shown in FIG. 1, especially a major part of magnet switch 600, is shown in FIG. 23 and explained in detail.

An upper opening portion 640*a* of the magnet switch yoke 640 is caulked around onto an outer periphery of stationary core 642. At an upper end portion of sleeve 651, a protrudent engaging portion 651*a* to engage with one end portion of attracting coil 650 is arranged. Protrudent engaging portion 651*a* projects in the radial direction from the outer periphery of sleeve 651. When attracting coil 650 is wound on the outer periphery of sleeve 651, one end of attracting coil 650 is caught by protrudent engaging portion 651*a* of sleeve 651, and the attracting coil is wound directly around the outer periphery of sleeve 651 by a predetermined number of turns. The other end portion of attracting coil is extended from magnet switch 600 and is connected to a load side terminal of a key switch, which is not shown. Attracting coil 650 is a copper wire covered by insulating coating.

After attracting coil 650 is wound, it is held between magnet switch yoke 640 and stationary core 642 via insulating washers 652*a* and 652*b*. As described above, magnet switch yoke 640 is caulked to be fixed with stationary core 642.

Figure 24A:
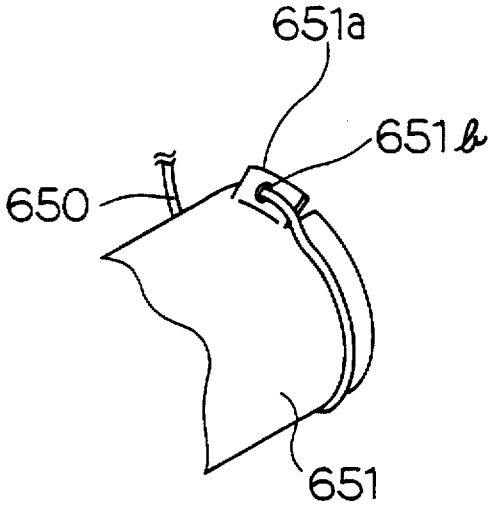
FIGS. 24A and 24B are partial perspective views showing the connecting state of a sleeve and an attracting coil shown in FIG. 23.
Figure 24B:
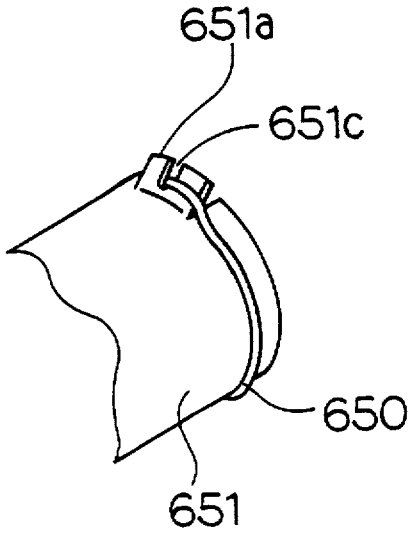
Figure 26:
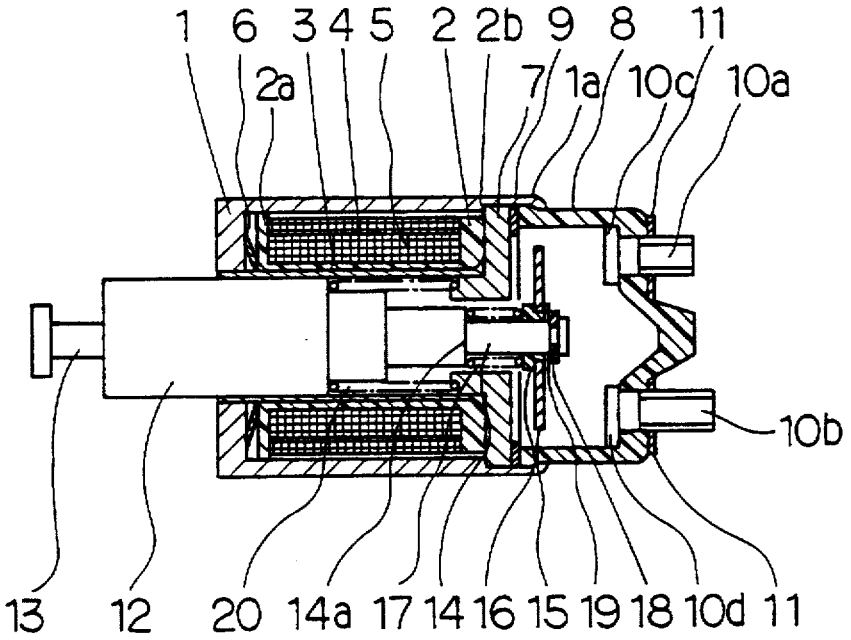
FIG. 26 PRIOR ART
FIG. 26 is a sectional view of a conventional magnet switch for a starter.
Figure 27:
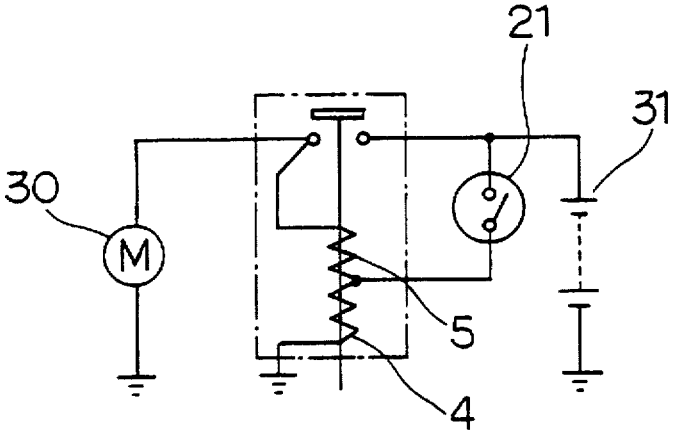
FIG. 27 PRIOR ART
FIG. 27 is a circuit diagram of the conventional starter shown in FIG. 26.

FIGS. 24A and 24B show the state of how protrudent engaging portion 651*a* of sleeve 651 engages attracting coil 650. Protrudent engaging portion 651*a* shown in FIG. 24A has a through hole 651*b* approximately in the center of the radially notched-and-raised upper opening portion of sleeve 651. When one end portion of attracting coil 650 is inserted into the through hole 651*b* and the coil is wound in the circumferential direction on sleeve 651 with a tensile force, attracting coil 650 is caught with the inner periphery of the through hole 651*b* by protrudent engaging portion 651*a* having an elasticity. Thus, insulating coating of attracting coil 650 is peeled off in the hole 651*b*, attracting coil 650 engages protrudent engaging portion 651*a*, and hence the electrical connection is secured therebetween.

Protrudent engaging portion 651*a* shown in FIG. 24B is formed with a slit 651*c* by notching the upper opening portion 651*a* of sleeve 651 in the axial direction and the notched part is raised in the radial direction. One end portion of attracting coil 650 is inserted into the slit 651*c*. When the coil 650 is wound in the circumferential direction on sleeve 651 with a tensile force, the attracting coil 650 is caught by an edge of the slit 651*c*. Thus insulating coating of the attracting coil 650 is peeled off, attracting coil 650 engages protrudent engaging portion 651*a*, and the electrical connection therebetween is secured.

After attracting coil 650 is wound around sleeve 651, the longitudinal length of attracting coil 650 is set longer than the length formed by an inner surface of magnet switch yoke 640 and an inner surface of stationary core 642 covering the opening portion of magnet switch yoke 640. A tightening length is provided in the longitudinal length of attracting coil 650 so that attracting coil 650 is fixed or tightened firmly after magnet switch yoke 640 is caulked with stationary core 642.

It is also possible to peel off the insulating coating of attracting coil 650 in advance and then to engage it with protrudent engaging portion 651*a* of sleeve 651.

In this embodiment, one end portion of attracting coil 650 is hooked at with protrudent engaging portion 651*a* of sleeve 651 and wound directly on sleeve 651. It is also possible to engage the one end portion of attracting coil with members such as stationary core 642 or magnet switch yoke 640 other than sleeve 651, and then to be wound directly on sleeve 651.

Next, plunger 610 is made of a magnetic metal, e.g., iron, and has a substantially cylindrical shape. Plunger 610 includes upper small diameter portion 613 and lower large diameter portion 614. The lower end of compression coil spring 660 is fitted to small diameter portion 613, and large diameter portion 614, which is relatively long in the axial direction, is held slidably axially in sleeve 651.

Plunger shaft 615 extends upward from plunger 610 and is fixed to the upper end of plunger 610. Plunger shaft 615 projects upward through a through hole provided in the center of stationary core 642. Upper movable contact 612 is fitted around plunger shaft 615 above stationary core 642 vertically slidably along plunger shaft 615. Upper movable contact 612 is limited by stopping ring (not shown) fitted to the upper end of plunger shaft 615 so that it does not move upward of the upper end of plunger shaft 615. As a result, upper movable contact 612 is vertically slidable along plunger shaft 615 between stopping ring and stationary core 642. Upper movable contact 612 is urged upward at all times by contact pressure spring 670 comprising a leaf spring fitted to plunger shaft 615.

Upper movable contact 612 is made of a metal such as copper having excellent electrical conductivity, and when both ends of upper movable contact 612 move upward, upper movable contact 612 abuts two abutting portions 631 provided onto fixed contact 630. Each lead wire 910*a* of a pair of brushes 910 are electrically and mechanically fixed to upper movable contact 612 by caulking or welding or the like. Also, the end portion of resistor member 617 constituting a plurality (in the present embodiment, two) of limiting means is inserted into a groove portion of upper movable contact 612 and electrically and mechanically fixed there.

Each lead wire 910*a* of brush 910 is electrically and mechanically fixed to upper movable contact 612 by caulking or welding, but upper movable contact 612 and each lead wire 910*a* of brushes 910 may be formed integrally.

Resistor member 617 is for rotating motor 500 at a low speed when the starter begins operation, and consists of a metal wire of high resistance wound through several turns. Lower movable contact 611 located below head portion 621 of terminal bolt 620 is fixed by caulking or the like to the other end of resistor member 617.

Lower movable contact 611 is made of a metal such as copper having excellent conductivity. When magnet switch 600 stops operation and plunger 610 is in its downward position, plunger 610 abuts the upper surface of stationary core 642. When resistor member 617 moves upward with movement of plunger shaft 615, before upper movable contact 612 abuts abutting portion 631 of fixed contact 630, lower movable contact 611 abuts head portion 621 of terminal bolt 620.

The lower surface of plunger 610 is provided with recess portion 682 which accommodates sphere 681 provided at the rear end of cord-shaped member 680 (for example a wire). Female thread 683 is formed on the inner wall of recess portion 682. Fixing screw 684 which fixes sphere 681 in recess portion 682 is screwed into recess portion 682. Fixing screw 684 also performs an adjustment of the length of cord-shaped member 680, by adjusting the extent to which fixing screw 684 is screwed into female thread 683. The length of cord-shaped member 680 is adjusted so that when plunger shaft 615 moves upward and lower movable contact 611 abuts terminal bolt 620, limiting claw 231 of pinion rotation limiting member 230 mates with projections 214 of the outer periphery of pinion gear 210. Female thread 683 and fixing screw 684 constitute an adjusting mechanism.

By taking this construction, attracting coil 650 having insulating coating is directly wound on sleeve 651 of non-magnetic and heat-conductive material, and the bottom portion of magnet switch yoke 640 or stationary core 642 contacts sleeve 651. Therefore, an influence of heat generated through current flow to motor 500 and heat generated at attracting coil 650 through current flow thereto are directly transmitted to plunger 610 contacting with sleeve 651 having heat-conductivity. The heat is also transmitted to magnet switch yoke 640 or stationary core 642 to be released, the decline of the attracting force of attracting coil 650 is repressed. Also, since magnet switch 600 is provided in the vicinity of an opposite end of pinion gear 210, starter does not interfere with the engine when starter is to be mounted to the engine. Thus, the starter mounting work becomes facilitated.

Further, in the starter where limiting claw 231 of rotation limiting member 230 engages projections 214 of pinion gear 210 and limits the rotation in order to shift pinion gear 210 to the side of ring gear 100 for engaging pinion 210 with ring gear 100 by the rotation of output shaft 220, it is not necessary to keep a balance of coils by maintaining approximately the same number of turns of the attracting coil and the holding coil as conventionally done but this operation may be attained by a single coil. Under the condition that one end portion of the attracting coil 650 is grounded and the coil is directly wound on the sleeve from the one end portion, for example, even when the first layer of attracting coil 650 is short-circuited to the sleeve 651 and the number of turns of attracting coil 650 substantially decreases, current flow increases in accordance with the decline of the resistance value. Therefore, an attracting force determined by the current ×the number of turns (the number of windings of the attracting coil) does not vary largely. In other words, since the attracting force does not vary and is enough to drive rotation limiting member 230, there is no need to give a special insulating treatment onto sleeve 651 when attracting coil 650 is wound on the outer circumference of the sleeve 651, thus achieving cost reduction.

Since a resinous bobbin is abolished, the heat resistance and vibration resistance of magnet switch 600 are drastically improved.

Since attracting coil 650 is held between magnet switch yoke of cylindrical shape having a bottom portion and stationary core 642 closing an opening portion of magnet switch yoke 640, attracting coil 650 is fixed firmly and the vibration resistance improves superbly.

Also, since attracting coil 650 is wound on sleeve 651 by engaging the tip portion of attracting coil 650 with a protrudent engaging portion 651*a*, attracting coil 650 is easily wound on sleeve 651 and hence the process of winding is shortened.

(End Frame 700)

Figure 18:
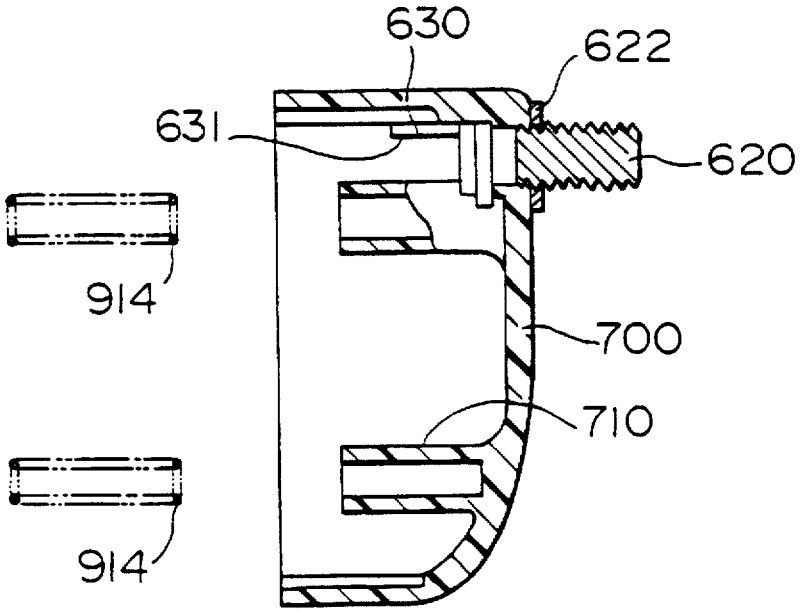
FIG. 18 is a sectional view of an end frame and a brush spring.

End frame 700, as shown in FIG. 18, is a magnet switch yoke made of resin (e.g., phenol resin) and accommodates magnet switch 600 therein. Spring holding pillars 710, which hold compression coil springs 914 that urge brushes 910 forward, are mounted so as to project from the rear surface of end frame 700 in positions corresponding to the positions of brushes 910.

Also, compression coil springs 914, as shown in FIG. 1, are disposed diametrally outward with respect to the axial direction of plunger 610 of magnet switch 600.

Terminal bolt 620 is a steel bolt which passes through end frame 700 from the inside and projects from the rear of end frame 700 and has at its front end head portion 621 which abuts the inner surface of end frame 700. Terminal bolt 620 is fixed to end frame 700 by caulking washer 622, which is attached to terminal bolt 620 projecting rearward of end frame 700. Copper fixed contact 630 is fixed to the front end of terminal bolt 620 by caulking. Fixed contact 630 has one or a plurality (in this embodiment, two) of abutting portions 631 positioned at the top end of the inside of end frame 700, and abutting portions 631 are mounted so that the upper surface of upper movable contact 612, which is moved up and down by the operation of magnet switch 600, can abut the lower surfaces of abutting portions 631.

(Brush Holding Member 900)

Brush holding member 900, separates the inside of yoke 501 and the inside of end frame 700 and rotatably supports the rear end of armature shaft 510 by way of brush holding member bearing 564. Brush holding member 900 also acts as a brush holder, a holder for magnet switch 600, and a holder for pulley 690, which guides cord-shaped member 680. Brush holding member 900 has a hole portion (not illustrated) through which cord-shaped member 680 passes.

Figure 19:
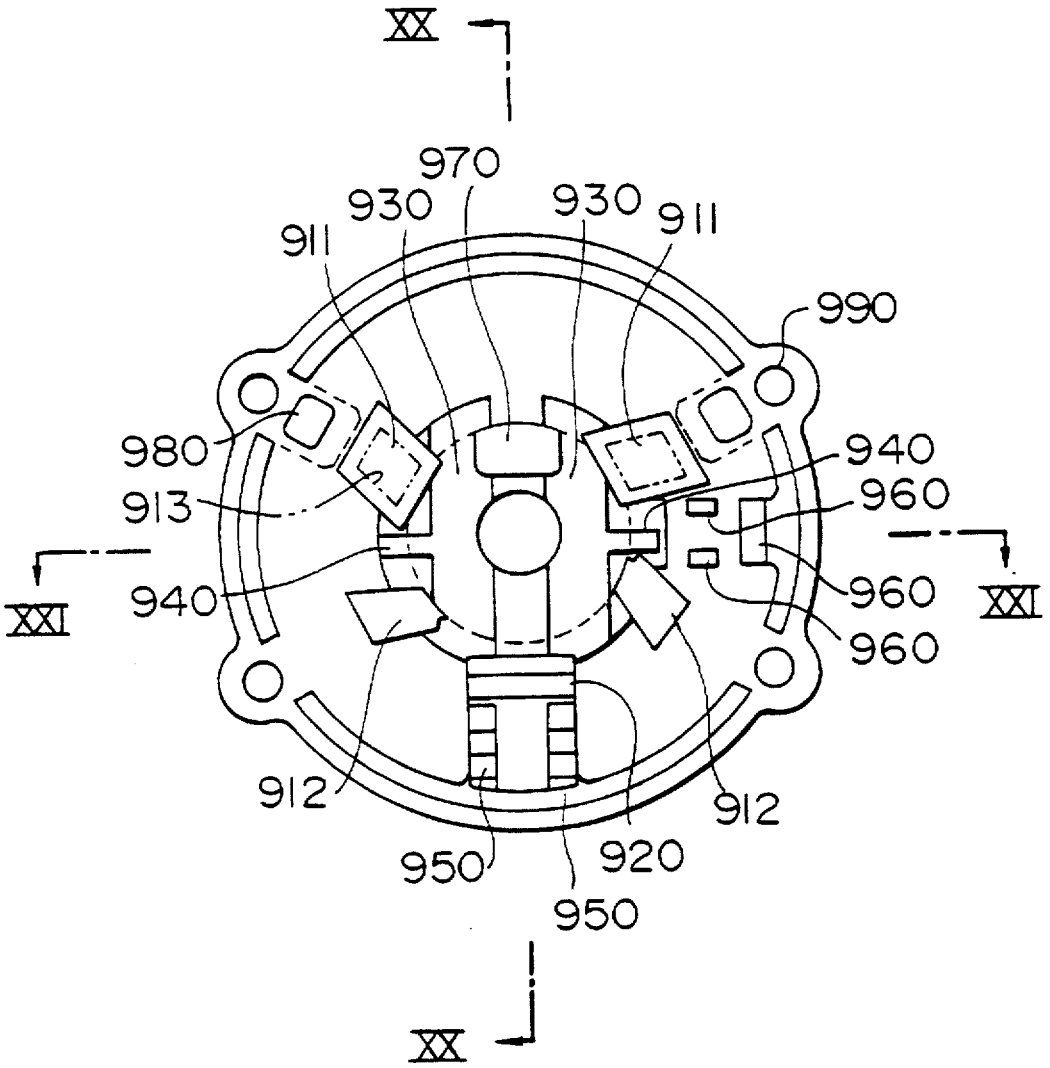
FIG. 19 is a front view of a brush holder.
Figure 20:
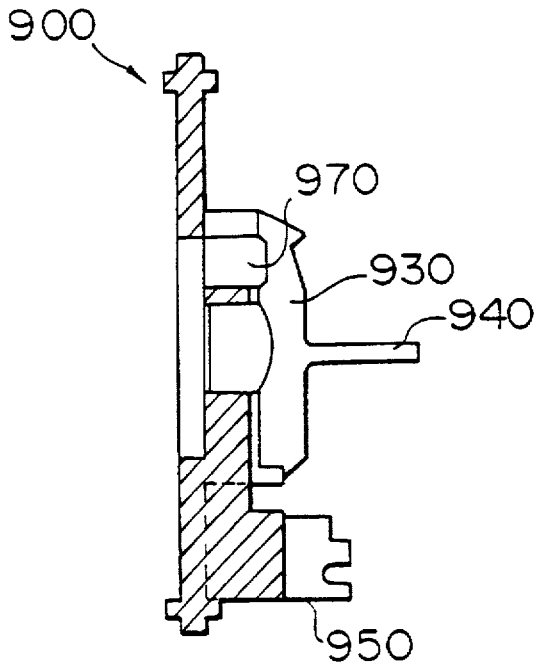
FIG. 20 is a sectional view taken along the line XX—XX of FIG. 19.
Figure 21:
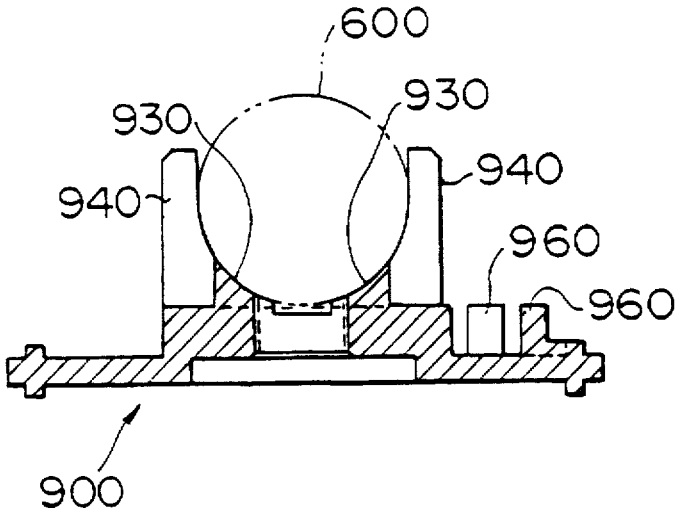
FIG. 21 is a sectional view taken along the line XXI—XXI of FIG. 19.

Brush holding member 900 is a spacing wall formed of a metal such as aluminum molded by a casting method. As shown in FIG. 19 through FIG. 21, brush holing member 900 has a plurality (in this embodiment, two upper and two lower) brush holding holes 911, 912 which hold brushes 910 in the axial direction. Upper brush holding holes 911 are holes which hold brushes 910 that receive a positive voltage, and upper brush holding holes 911 hold brushes 910 by way of resin (e.g., nylon, phenol resin) insulating cylinders 913. (FIG. 20 is a sectional view taken along the line XX—XX of FIG. 19 and FIG. 21 is a sectional view taken along the line XXI—XXI of FIG. 19.) Lower brush holding holes 912 are holes which hold brushes 910 connected to ground, and lower brush holding holes 912 hold respective brushes 910 directly therein.

The front end surface of brushes 910 are urged against upper layer coil ends 534 at rear ends located the rear side of armature coils 530 by compression coil springs 914.

Lead wires 910*a* of upper brushes 910 are electrically and mechanically joined by a joining method such as welding or caulking to upper movable contact 612 which is moved by magnet switch 600. Lead wires 910*a* of the lower brushes 910 are caulked and thereby electrically and mechanically joined to concave portion 920 formed in the rear surface of brush holding member 900. In this embodiment a pair of lower brushes 910 are provided, one lead wire 910*a* is connected to the pair of lower brushes 910, and the middle of lead wire 910*a* is caulked in concave portion 920 formed in the rear surface of brush holding member 900.

Two seats 930 with which the front side of magnet switch 600 abuts and two fixing pillars 940, which hold the periphery of magnet switch 600, are formed on the rear side of brush holding member 900.

Seats 930 are shaped to match the external shape of magnet switch 600 in order to abut magnet switch 600, which has a cylindrical exterior. Two fixing pillars 940, with magnet switch 600 in abutment with seats 930, by having their rear ends caulked to the inner side, hold magnet switch 600.

Pulley holding portion 950, which holds pulley 690 that converts the direction of movement of cord-shaped member 680 from the vertical direction of magnet switch 600 into the axial direction thereof, is formed on the lower side of the rear side of brush holding member 900.

(Operation of the First Embodiment)

Figure 22A:
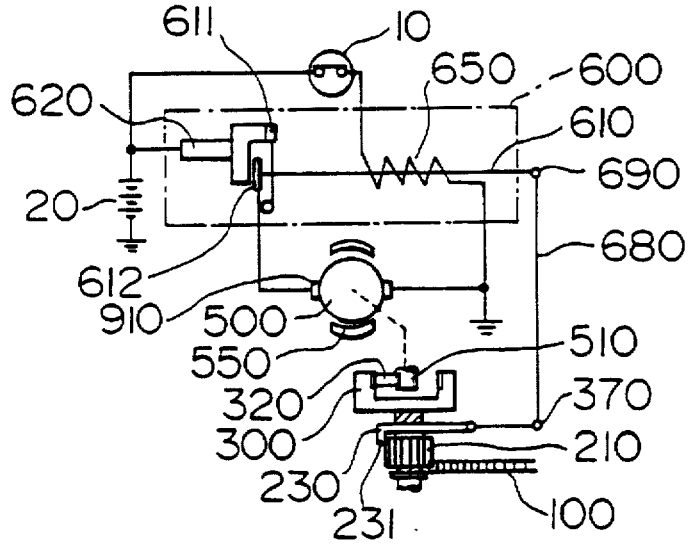
FIGS. 22A, 22B, and 22C are electrical circuit diagrams in which the operating state of a pinion is shown.
Figure 22B:
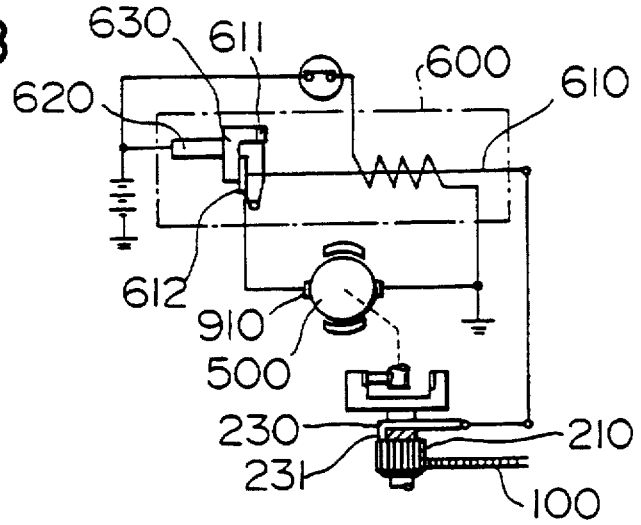
Figure 22C:
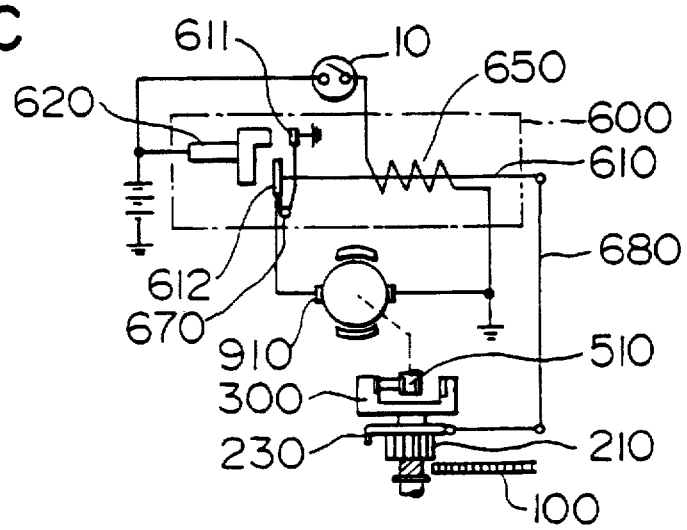

Next, operation of the starter described above will be explained with reference to the electrical circuit diagrams shown in FIGS. 22A through 22C.

When key switch 10 is set to the start position by a driver, current flows from battery 20 to attracting coil 650 of magnet switch 600. When current flows through attracting coil 650, plunger 610 is pulled by the magnetic force produced by attracting coil 650, and plunger 610 ascends from its lower position to its upper position.

When plunger 610 starts to ascend, together with the ascent of plunger shaft 615, both upper movable contact 612 and lower movable contact 611 ascend, and the rear end of cord-shaped member 680 also ascends. When the rear end of cord-shaped member 680 ascends, the front end of cord-shaped member 680 is pulled down, and rotation limiting member 230 descends. When the descent of rotation limiting member 230 causes limiting claw 231 to mate with projections 214 of the periphery of pinion gear 210, lower movable contact 611 abuts head portion 621 of terminal bolt 620 as shown in FIG. 22A. Current flows from battery 20 to terminal bolt 620, and current is made to flow through lower movable contact 611 as follows. Current is made to flow to resistor member 617, and in turn to upper movable contact 612. From upper movable contact 612, current is made to flow to lead wires 910*a* leading to upper brushes 910. That is, the low voltage current passing through resistor member 617 is transmitted through upper brushes 910 to armature coils 530. Because the lower brushes 910 are constantly grounded through brush holding member 900, a current flows at a low voltage through armature coils 530 constituted in coil form by paired upper layer coil bars 531 and lower layer coil bars 532. When this happens, armature coils 530 generate a relatively weak magnetic force that acts on (i.e., attracts or repels) the magnetic force of fixed poles 550. Thus, armature 540 rotates at low speed.

When armature shaft 510 rotates, planetary gears 320 of planetary gear mechanism 300 are rotationally driven by sun gear 310 on the front end of armature shaft 510. When planetary gears 320 exert a rotational torque through planet carrier 330 on internal gear 340 in the direction which rotationally drives ring gear 100, the rotation of internal gear 340 is limited by the operation of overrunning clutch 350. That is, because internal gear 340 does not rotate, the rotation of planetary gears 320 causes planet carrier 330 to rotate at low speed. When planet carrier 330 rotates, pinion gear 210 also rotates, but because pinion gear 210 has its rotation limited by rotation limiting member 230, pinion gear 210 advances along helical spline 221 on output shaft 220.

Together with the advance of pinion gear 210, shutter 420 also advances, and opens opening portion 410 of housing 400. The advance of pinion gear 210 causes pinion gear 210 to mesh completely with ring gear 100 of the engine and then abut pinion stopping ring 250. Also, when pinion gear 210 advances, limiting claw 231 disengages from projections 214 of pinion gear 210. Then, the front end of limiting claw 231 drops to the rear side of washer 215 disposed on the rear side of pinion gear 210.

With pinion gear 210 advanced, upper movable contact 612 abuts an abutting portion 631 of fixed contact 630. When this happens, the battery voltage of terminal bolt 620 is directly transmitted through upper movable contact 612 to lead wires 910*a* leading to upper brushes 910. That is, a high current flows through armature coils 530 comprising upper layer coil bars 531 and lower layer coil bars 532. Armature coils 530 thus generate a strong magnetic force and armature 540 rotates at high speed.

The rotation of armature shaft 510 is reduced in its speed and has its rotational torque increased by planetary gear mechanism 300 and rotationally drives planet carrier 330. At this time, the front end of pinion gear 210 abuts pinion stopping ring 250 and pinion gear 210 rotates integrally with planet carrier 330. Because pinion gear 210 is meshing with ring gear 100 of the engine, pinion gear 210 rotationally drives ring gear 100 and rotationally drives the output shaft of the engine.

Next, when the engine starts and ring gear 100 of the engine rotates faster than the rotation of pinion gear 210, the action of helical spline 221 creates a force tending to retract pinion gear 210. However, limiting claw 231 which has dropped to behind pinion gear 210 prevents pinion gear 210 from retracting, prevents early disengagement of pinion gear 210, and enables the engine to be started surely (FIG. 22B).

When the starting of the engine causes ring gear 100 to rotate faster than the rotation of pinion gear 210, the rotation of ring gear 100 rotationally drives pinion gear 210. When this happens, the rotational torque transmitted from ring gear 100 to pinion gear 210 is transmitted through planet carrier 330 to pin 332 which supports planetary gears 320. That is, planetary gears 320 are driven by planet carrier 330. When this happens, because a torque rotationally opposite to that which occurs during engine starting is exerted on internal gear 340, overrunning clutch 350 allows the rotation of ring gear 100. That is, when a torque rotationally opposite to that during engine starting is exerted on internal gear 340, roller 353 of overrunning clutch 350 detaches to outside concave portion 355 of clutch inner member 352 and rotation of internal gear 340 becomes possible.

In other words, the relative rotation with which ring gear 100 rotationally drives pinion gear 210 when the engine starts is absorbed by overrunning clutch 350, and armature 540 is never rotationally driven by the engine.

When the engine starts, the driver releases key switch 10 from the start position and the flow of current to attracting coil 650 of magnet switch 600 is stopped. When the flow of current to attracting coil 650 stops, plunger 610 is returned downward by the action of compression coil spring 660.

When this happens, upper movable contact 612 moves away from abutting portion 631 of fixed contact 630, and after that lower movable contact 611 also moves away from head portion of terminal bolt 620, and the flow of current to upper brushes 910 is stopped.

When plunger 610 is returned downward, the action of return spring portion 233 of rotation limiting member 230 causes rotation limiting member 230 to move back upward, and limiting claw 231 moves away from the rear of pinion gear 210. When this happens, pinion gear 210 is returned rearward by the action of return spring 240, the meshing of pinion gear 210 with ring gear 100 of the engine is disengaged, and the rear end of pinion gear 210 abuts with the flange-like projecting portion of output shaft 220. That is, pinion gear 210 is returned to the position it was in before the starter was started (FIG. 22C).

Also, the return of plunger 610 downward causes lower movable contact 611 to abut the upper surface of stationary core 642 of magnet switch 600. The lead wires of upper brushes 910 conduct electrical current in the following order. From upper movable contact 612 to the resistor member 617, and then to lower movable contact 611, voltage is then transmitted to stationary core 642. Stationary core 642 transmits voltage to magnet switch yoke 640, which in turn transmits voltage to brush holding member 900. In other words, upper brushes 910 and lower brushes 910 short-circuit through brush holding member 900. Meanwhile, inertial rotation of armature 540 generates an electromotive force in armature coils 530. Because this electroomotive force is short-circuited through upper brushes 910, brush holding member 900, and lower brushes 910, a braking force is exerted on the inertial rotation of armature 540. As a result, armature 540 rapidly stops rotation.

(Another Embodiment)

Figure 25:
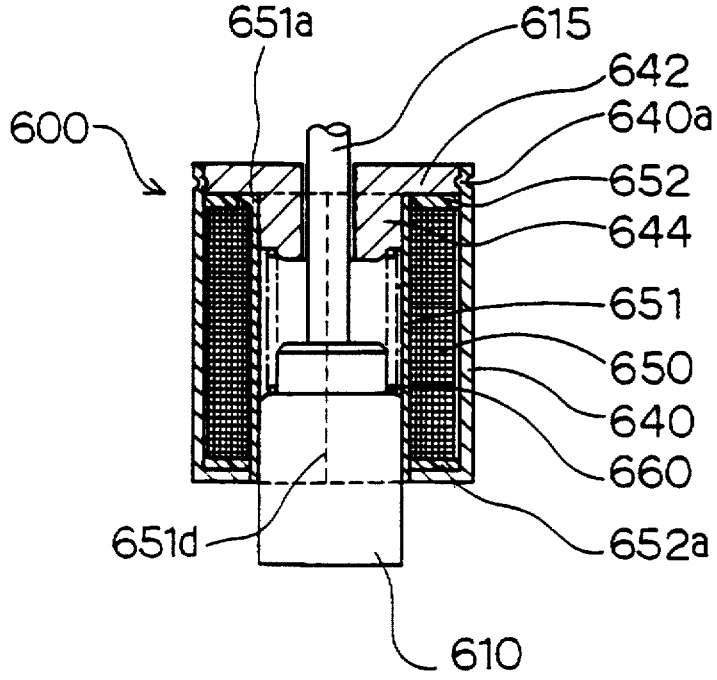
FIG. 25 is a sectional view of a major part of a magnet switch for a starter according to another embodiment of the present invention.

FIG. 25 is another embodiment of the present invention. Sleeve 651 is formed by rolling nonmagnetic metal plate cylindrically and has a seam 651*d* connecting contact faces.

According to this construction, since sleeve 651 is connected at the seam 651*d* connecting contact faces by rolling the metal plate, sleeve 651 itself has an elasticity of a spring-back function in the radial direction. Therefore, attracting coil 650 wound on the outer periphery of sleeve 651 becomes loose-resistant. Also, an effect that the heat is transmitted to sleeve 651 effectively because of a tight contact of attracting coil 650 and sleeve 651, is obtained.

(Effect of the Embodiments)

Since attracting coil 650 having insulating coating is directly wound on sleeve 651 of non-magnetic and heat-conductive material and the bottom portion of magnet switch yoke 640 or stationary core 642 contacts sleeve 651, an influence of the heat generated by current flow to motor 500 and the heat generated at attracting coil 650 by current flow thereto are directly transmitted to plunger 610 which contacts sleeve 651 of heat-conductive material as well as to magnet switch yoke 640 or stationary core 642. Therefore, the decline of the attracting force of attracting coil 650 is repressed. The starter does not interfere with the engine when the starter is to be mounted on the engine, since the magnet switch 600 is provided in the vicinity of the opposite end of pinion gear 210 of motor 500 and the mounting work becomes facilitated.

Further, in the starter where limiting claw 231 of rotation limiting member 230 engages projections 214 of pinion gear 210 and limits the rotation in order to shift pinion gear 210 to the side of ring gear 100 for meshing pinion gear 210 with ring gear 100 by the rotation of output shaft 220, it is not necessary to keep a balance of coils by maintaining approximately the same number of turns of the attracting coil and the holding coil, since such operation can be attained by a single coil. In the case that one end portion of attracting coil 650 is grounded and the coil is directly wound on the sleeve 651 from the one end portion, for example, even when the first layer of attracting coil 650 is short-circuited to sleeve 651 and the number of turns of the coil 650 substantially decreases, current flow increases in accordance with the decline of the resistance value. Therefore, the attracting force determined by the current x the number of turns (the number of windings of the attracting coil) does not vary largely. In other words, the attracting force does not vary and is enough to drive rotation limiting member 230. There is no need to give a special insulating treatment onto sleeve 651 when attracting coil 650 is wound on the outer circumference of sleeve 651, therefore the cost reduction is achieved.

Also, since resinous bobbin is eliminated, heat resistance and vibration resistance of magnet switch 600 are drastically improved.

Since attracting coil 650 is held between magnet switch yoke 640 of cylindrical shape having a bottom portion and stationary core 642 closing an opening portion of magnet switch yoke 640, attracting coil 650 is fixed firmly and vibration resistance improves superbly.

What is claimed is:

1. A starter comprising:

a starter motor;

an output shaft driven by said starter motor;

a pinion gear provided at one axial side of said starter motor for engaging with said output shaft through a helical spline and for meshing with a ring gear of an engine;

a magnet switch provided in a vicinity of the other axial side of said starter motor for flowing current to said starter motor and for shifting said pinion gear to a direction of said ring gear;

said magnet switch having a coil with insulating coating thereon for generating magnetomotive force upon current flow, a sleeve made of non-magnetic and heat-conductive material, and a plunger made of magnetic material and provided slidably in an inner circumference of said sleeve; and said coil having one end portion grounded, and being directly wound on an outer circumference of said sleeve therefrom; wherein said sleeve has an engagement portion raised at an axial end thereof for electrical connection with said one end portion of said coil.

2. A starter according to claim 1 further comprising:

a magnet switch yoke made of magnetic material having a cylindrical shape with a bottom and disposing said coil in an inner circumference thereof;

a stator core made of magnetic material and fixed to said magnet switch yoke at an opening portion of said magnet switch yoke; and said sleeve contacting with at least one of said stator core and said magnet switch yoke.

3. A starter according to claim 2, wherein said sleeve, said plunger, said yoke and said stator core are made of heat-conductive metals.

4. A starter according to claim 1, wherein:

said sleeve is formed by rolling a metal plate and has a seam connecting contact faces.

5. A starter according to claim 1, wherein said sleeve is made of metal; and said plunger is made of heat-conductive metal.

6. A starter according to claim 1, wherein said magnet switch is disposed adjacent to a brush of said starter motor.

7. A starter according to claim 1, wherein said plunger is made of heat-conductive material.

8. A starter comprising:

a starter motor;

an output shaft driven by said starter motor;

a pinion shifting member having a pinion gear provided at one axial side of said starter motor for engaging with said output shaft through a helical spline and for meshing with a ring gear of an engine;

a rotation limiting member for shifting said pinion gear to a side of said ring gear through rotation of said output shaft and said helical spline by way of contacting with and limiting rotation of said pinion shifting member;

a magnet switch provided in a vicinity of the other axial side of said starter motor for actuating said rotation limiting member upon current flow thereto and for flowing an electric current to said starter motor; and said magnet switch having a coil with insulating coating thereon for generating magnetomotive force upon current flow, a sleeve of non-magnetic and heat-conductive material, and a plunger of magnetic material provided slidably in an inner circumference of said sleeve.

9. A starter according to claim 8, wherein:

said sleeve is formed by rolling a metal plate and has a seam connecting contact faces.

10. A starter according to claim 9, wherein said sleeve, said plunger, said yoke and said stator core are made of heat-conductive metals.

11. A starter according to claim 8 further comprising:

a magnet switch yoke of magnetic material having a cylindrical shape with a bottom and disposing said coil in an inner circumference thereof;

a stator core of magnetic material and fixed to said magnet switch yoke at an opening portion of said magnet switch yoke; and said sleeve contacting at least one of said stator core and said magnet switch yoke; and said coil having one end grounded, and directly wound on an outer circumference of said sleeve therefrom.

12. A starter according to claim 11, wherein said plunger is made of heat-conductive material.

13. A starter according to claim 11 wherein said sleeve is made of metal; and said plunger is made of heat-conductive metal.

14. A starter according to claim 11, wherein said magnet switch is disposed adjacent to a brush of said starter motor.

15. A starter according to claim 11, wherein said sleeve has an engagement portion raised at an axial end thereof for electrical connection with said one end portion of said coil.

16. A starter according to claim 8, wherein said plunger is made of heat-conductive material.

17. A starter according to claim 8, wherein said coil has one end grounded, and directly wound on an outer circumference of said sleeve therefrom.

18. A starter according to claim 8, wherein said sleeve is made of metal; and said plunger is made of heat-conductive metal.

19. A starter according to claim 8, wherein said magnet switch is disposed adjacent to a brush of said starter motor.

20. A starter according to claim 8, wherein said sleeve has an engagement portion raised at an axial end thereof for electrical connection with said one end portion of said coil.

* * * * *